US007281479B2

(12) United States Patent
Watanabe et al.

(10) Patent No.: US 7,281,479 B2
(45) Date of Patent: Oct. 16, 2007

(54) NEEDLE THREADING DEVICE FOR SEWING MACHINE AND SEWING MACHINE

(75) Inventors: Yasuhiro Watanabe, Tokoname (JP); Akira Terao, Ama-gun (JP); Kazutoshi Hayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 69 days.

(21) Appl. No.: 11/290,588

(22) Filed: Dec. 1, 2005

(65) Prior Publication Data

US 2006/0118017 A1 Jun. 8, 2006

(30) Foreign Application Priority Data

Dec. 2, 2004 (JP) ..... 2004-349398

(51) Int. Cl.
*D05B 87/02* (2006.01)
*D05B 55/14* (2006.01)

(52) U.S. Cl. ..... 112/225

(58) Field of Classification Search ..... 112/225, 112/302, 254, 255; 223/99; 83/901, 905, 83/937

See application file for complete search history.

(56) References Cited

U.S. PATENT DOCUMENTS 5,003,900 A * 4/1991 Ogawa ..... 112/242
5,596,940 A 1/1997 Yamada et al.
5,615,629 A * 4/1997 Yamada et al. ..... 112/225
6,067,919 A 5/2000 Shoji
6,701,858 B2 * 3/2004 Wacker ..... 112/225
6,918,344 B2 * 7/2005 Ebata et al. ..... 112/225
6,973,888 B2 * 12/2005 Yoshikazu ..... 112/225

FOREIGN PATENT DOCUMENTS

| | | |
|---|---|---|
| JP | 03-128092 | 5/1991 |
| JP | 03-133484 | 6/1991 |
| JP | 04-141191 | 5/1992 |
| JP | 2000-200387 | 7/2000 |
| JP | 2002-200387 | 7/2002 |

* cited by examiner

*Primary Examiner*—Ismael Izaguirre
(74) *Attorney, Agent, or Firm*—Oliff & Berridge, PLC

(57) ABSTRACT

A needle threading device of a sewing machine comprising a needle threading shaft mounted rotatably and vertically movably; a needle threading hook fixed to a lower end of the needle threading shaft; and a rotating mechanism that rotates the needle threading shaft such that the needle threading hook passes through a needle eye of the sewing needle. In a such a needle threading device, a first thread guide member is fixed to a lower end of the needle threading shaft and arranged opposed to the needle threading book with respect to the needle threading shaft; a second thread guide member is pivotally mounted on the lower end of the needle threading shaft and linked to the first thread guide member via a link mechanism. The second thread guide member is mounted with a thread retaining unit that retains the upper thread upon needle hooking.

24 Claims, 20 Drawing Sheets

NEEDLE THREADING DEVICE FOR SEWING MACHINE AND SEWING MACHINE

CROSS-REFERENCE TO RELATED APPLICATIONS

This application is based upon and claims the benefit of priority from the prior Japanese Patent Application No. 2004-349398, filed on Dec. 2, 2004 the entire contents of which are incorporated herein by reference.

TECHNICAL FIELD

The disclosure relates to a needle threading device of a sewing machine and a sewing machine capable of threading a sewing needle with an upper thread drawn from a thread spool, as well as reliably pulling out the upper thread end from the needle eye of the sewing needle.

BACKGROUND

An electronic sewing machine equipped with a needle threading device has conventionally been used to form stitches on a workpiece cloth. Such a needle threading device of the sewing machine is capable of threading a sewing needle with ease by manually operating a needle threading lever after hooking an upper thread drawn from a thread spool onto a thread tension regulator, a thread take-up, and the like.

For example, a needle threading device of a sewing machine disclosed in Japanese Patent No. 2002-200387 is provided with a needle threading shaft and a slider guide shaft supported vertically movably by a needle bar base that supports a needle bar and a hook retaining member fixed to a lower end of a needle threading shaft. The aforementioned needle threading device is further provided with a hook mechanism fixed to the hook retaining member, a first thread guide member fixed to the hook retaining member and a second thread guide member which is substantially C-shaped in side view and is rotatably supported by the lower end of the needle threading shaft, and the like. Furthermore, in the above described needle threading device, the upper thread drawn from the thread spool is hooked onto predetermined thread hooking portions then to the needle bar thread guide and onto the first and the second thread guide members. After retaining the upper thread by thread guide discs (thread retaining member) provided on the lower end of the needle threading shaft and the slider guide shaft, the upper thread is cut by the thread cutter provided on a sewing machine head.

In such construction, when the needle threading operation lever is lowered, the needle threading shaft is rotated after the needle threading shaft and the slider guide shaft are lowered to the predetermined position. By the rotation of the needle threading shaft, the first and the second thread guide members rotate in the direction moving away from each other and cooperatively retain the upper thread in a predetermined location near the needle eye of the sewing needle while the needle threading hook also rotates so as to pass through the needle eye of the sewing needle and hooks the upper thread. Then, when the needle threading operation lever is released, the needle threading hook is rotated in the reverting direction and pulled out of the needle eye with the upper thread hooked. Then, the needle threading shaft and the slider guide shaft are raised simultaneously, and the needle threading is completed.

In the needle threading device of a sewing machine disclosed in Japanese Patent No. 2002-200387, the upper thread is hooked by the needle threading hook and pulled back in the rear of the needle eye. However, the thread end of the upper thread remains in the front side of the needle eye without being pulled out therefrom; consequently forming an upper thread loop in the rear of the needle eye and the needle threading operation is terminated in such state. Therefore, the user is required to pull out the upper thread end from the needle eye by pulling the upper thread loop reward with his/her fingers, which complicates and interrupts the needle threading work.

As described above, the reason for not being able to pull out the thread end of the upper thread from the needle eye of the sewing needle is that the length of the thread end required for needle threading cannot be shortened. The reason for not being able to shorten the length of the thread end is that the distance of the vertical movement of the needle threading hook from a stand-by position, in which the thread is hooked, to a needle threading position, in which the needle threading hook is rotated after being lowered, is small. Another reason is that a thread retaining member that retains the thread end of the upper thread and a thread cutter that cuts the upper thread are distanced from the needle eye of the sewing needle, thereby being unable to shorten the length of the thread end required for needle threading.

In such case, in order to resolve the first reason, the vertical movement of the needle threading hook can be increased to a possible extent so as to reliably pull out the thread end from the needle eye by the reverting movement of the needle threading hook. However, in a household electronic sewing machine where size reduction is a critical demand, a plurality of mechanisms such as a needle bar vertically moving mechanism, a needle bar swinging mechanism, presser foot vertically moving mechanism are arranged in a compact manner in the sewing machine head; hence, it is difficult to secure enough vertical space. Thus, it is not possible to increase the vertical movement range of the needle threading hook.

Also, to resolve the second reason of being unable to shorten the length of the thread end required for threading because of the distanced arrangement of the thread retaining member that holds the thread end and the thread cutter that cuts the upper thread from the needle eye of the sewing needle, the following can be conceived. The thread retaining member and the thread cutter can be disposed close to the sewing needle. This is aimed to shorten the length of the thread end and to allow the thread end to be reliably pulled out by the reverting movement of the needle threading hook. However, since the thread retaining member is arranged to be provided in the lower stream in the thread supplying direction than the second thread guide member, the thread retaining member is compelled to be placed in a remote location, therefore, the thread end length cannot be shortened.

Furthermore, since the thread end length for needle threading, that is, the thread end length at the time of sewing start is long, after completion of sewing, the thread end extending from the workpiece cloth in the sewing start position need to be cut off, leading to a waste of sewing thread.

SUMMARY

Therefore an object of the present disclosure is to provide a needle threading device and a sewing machine capable of reliably pulling out a thread end of an upper thread from a needle eye of a sewing needle at the time of needle threading the sewing needle eye with the upper thread; thereby reliably executing the needle threading operation.

The needle threading device of a sewing machine of the present invention includes a needle threading shaft provided rotatably and vertically movably near the needle bar of a sewing machine; a needle threading hook which is fixed to the lower end of the needle threading shaft and which is capable of passing through the needle eye of the sewing needle, and a rotating mechanism that rotates the needle threading shaft so that the needle threading hook passes through the needle eye of the sewing needle when the needle threading shaft is lowered near a lowermost position thereof.

The needle threading device is further provided with a first thread guide member which is fixed to the lower end of the needle threading shaft and which is arranged to the opposite side of the needle threading hook with respect to the needle threading shaft. The needle threading device is also provided with a second thread guide member which is rotatably pivoted in the lower end of the needle threading shaft and which is linked to the first thread guide member via a link mechanism whereupon rotation of the needle threading shaft the upper thread is retained in a predetermined location near the needle eye cooperatively with the first thread guide member. A thread retaining unit that retains the upper thread at the time of hooking the thread is provided to the second thread guide member.

In the needle threading device of a sewing machine constructed as described above, upon performing the needle threading operation, the upper thread drawn from the thread spool is hooked on the predetermined thread hooking portions, the first thread guide member and the second thread guide member. Then, after the needle threading shaft has been lowered to the lowermost position, the first thread guide member is rotated in the same direction as the needle threading shaft. On the other hand, the second thread guide member is rotated via the link mechanism in a different direction from the first thread guide member, that is, to the direction that approaches the needle threading hook.

At this point, the thread end of the upper thread is retained as to be held between the second thread guide member and the thread retaining unit provided thereto and the upper thread is horizontally disposed near the needle eye of the sewing needle by the first and the second thread guide members. In such state, the needle threading hook proceeds with the advancing movement in which the needle threading hook passes through the needle eye and hooks the upper thread disposed immediately in front of the sewing needle. Then, in the reverting movement, the needle threading hook pulls out the hooked upper thread from the needle eye. That is, since the second thread guide member approaches the needle threading hook while retaining the thread end of the upper thread cooperatively with the thread retaining unit, the loosening of the upper thread is prevented upon the advancing movement in which the needle threading hook passes through the needle eye and hooks the upper thread immediately displaced in front of the sewing needle. Moreover, since the thread end of the upper thread is retained near the needle eye cooperatively by the thread retaining unit and the second thread guide member, even if the length of the thread end required for threading is short, needle threading can be reliably performed.

In the above construction, it is desirable to provide a thread guide portion to the second thread guide member. It is also desirable for the second thread guide member to have a thread introducing portion that introduces the upper thread to the thread guide portion. Such arrangement offers an especially preferred construction wherein the thread retaining unit is provided with: a thread retaining member that is capable of moving between an opened position in which the thread introducing portion is opened to allow the hooking of the upper thread and a closed position in which the thread introducing portion is closed and the upper thread guided to the thread guide portion is retained in cooperation with the second thread guide member; and a elastic member that biases the thread retaining member to the closed position.

It is furthermore preferable for the thread retaining member to be located in the opened position when the second thread guide member is in the stand-by position at the time of hooking the upper thread and to be moved to the closed position when the second thread guide member starts rotating from the stand-by position to the direction of the needle eye of the sewing needle.

Yet, it is even more preferable for the needle threading device to be provided with a needle threading operation unit that activates the needle threading device, a thread tension mechanism that adjusts the thread tension of the upper thread and a thread tension controlling unit that controls the thread tension mechanism; and upon needle threading the needle eye by the aforementioned needle threading operation unit, the value set for upper thread tension is controlled to a predetermined value that prevents the drawing of the upper thread by the thread tension controlling unit.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION OF THE INVENTION

Figure 1:
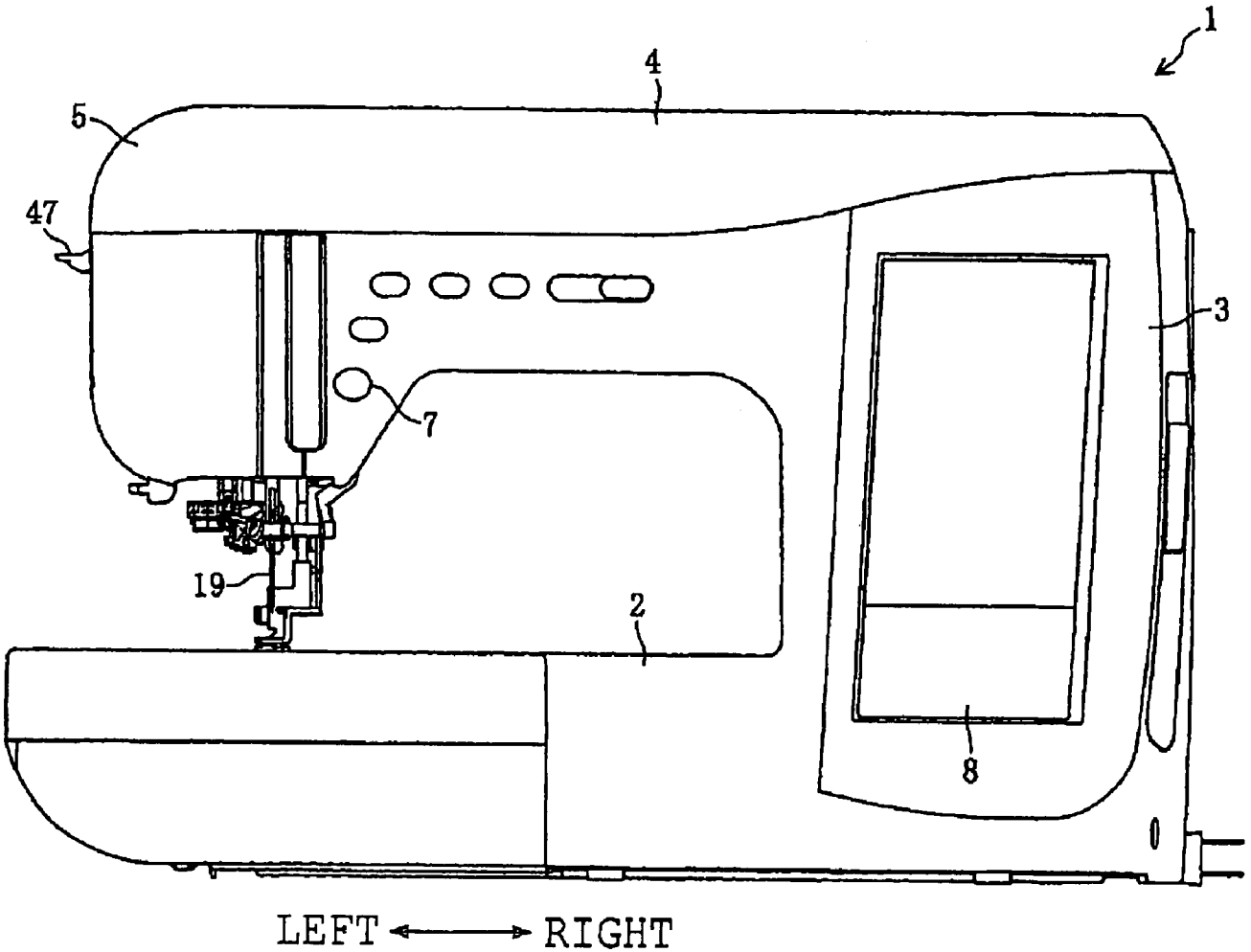
FIG. 1 is a front view of an electronic sewing machine according to an illustrative aspect of the present disclosure.
Figure 2:
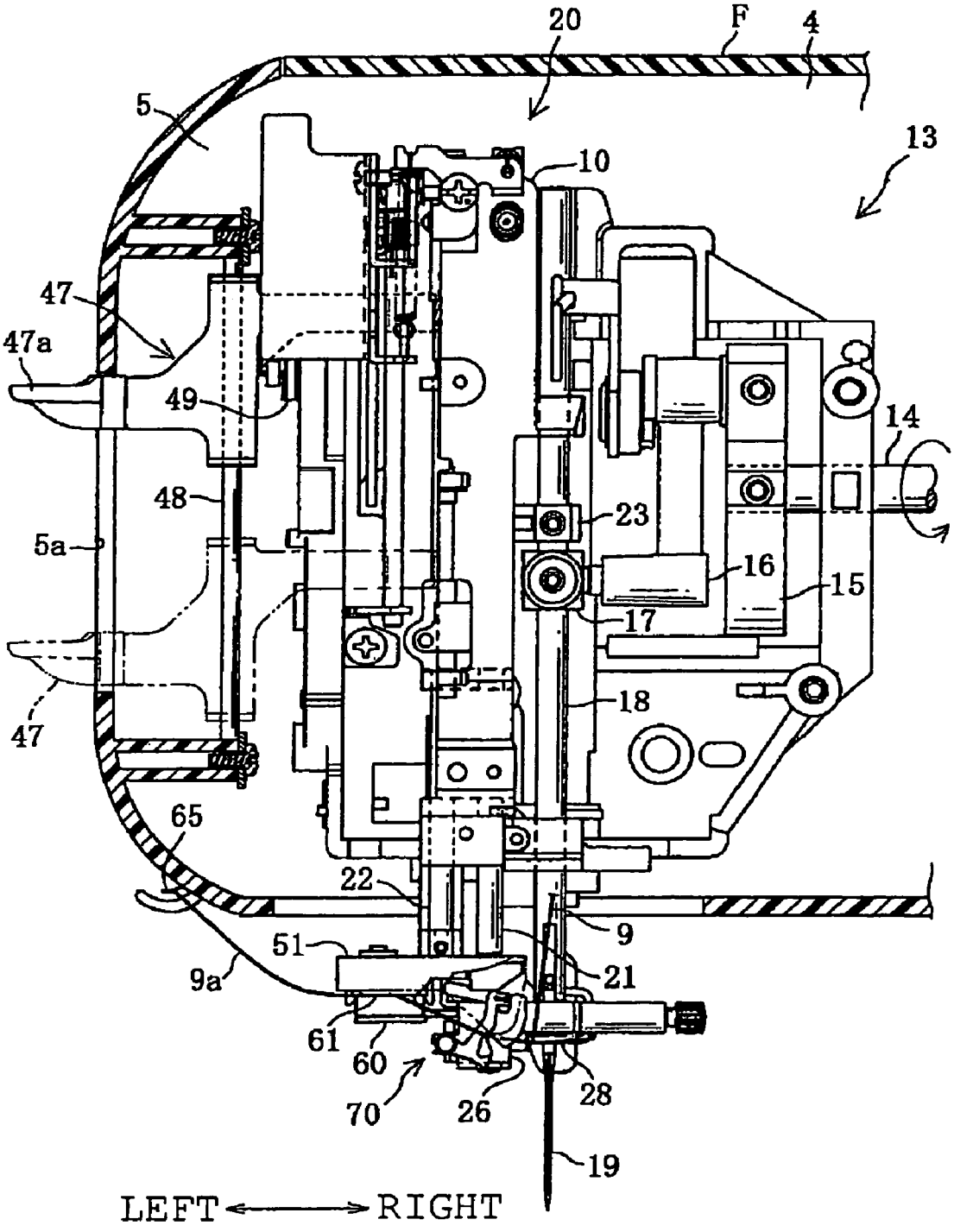
FIG. 2 is a fragmentary sectional front view indicating an inner mechanism of an arm of an electronic sewing machine.
Figure 3:
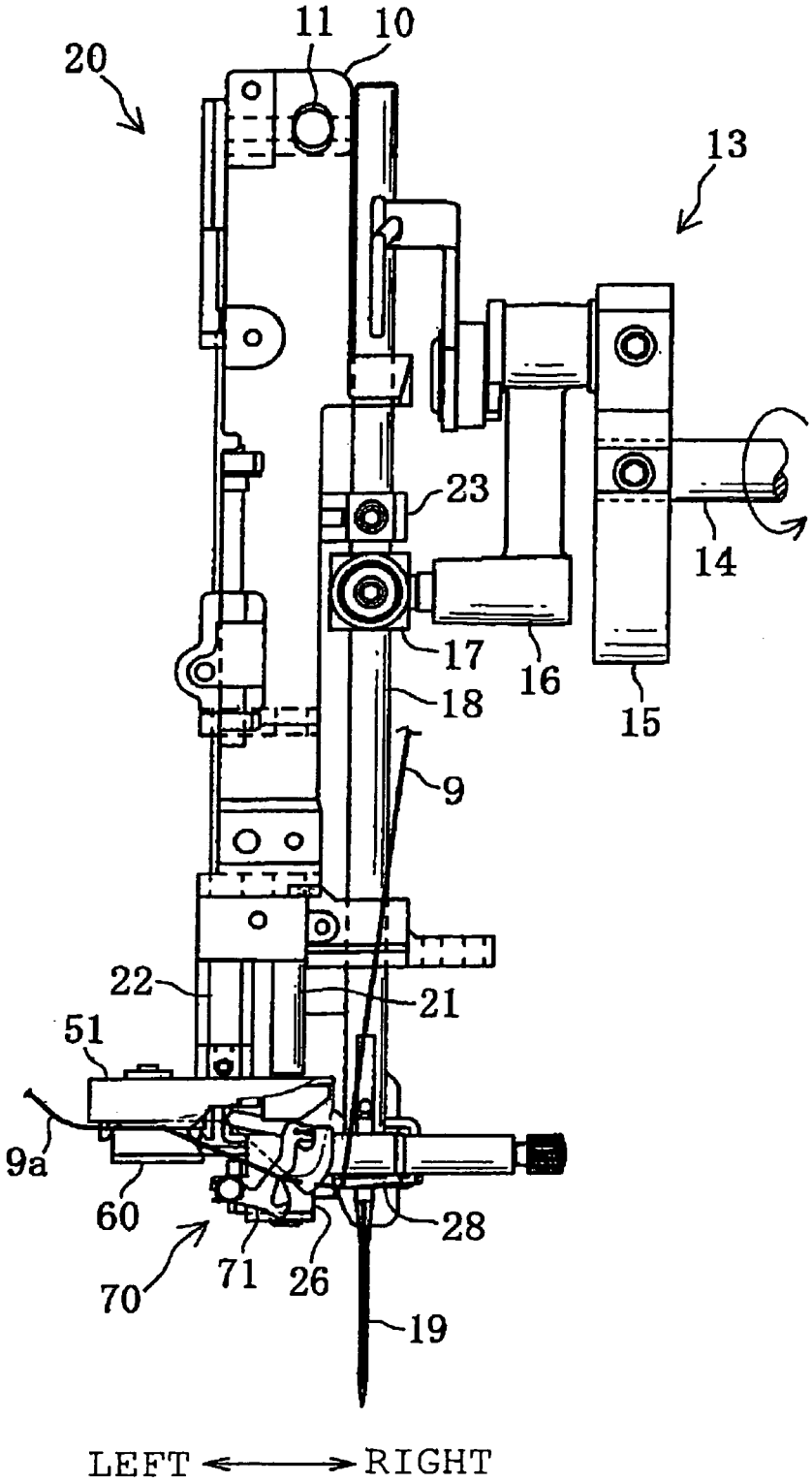
FIG. 3 is a front view of a needle threading device.

A first embodiment in which the present invention is applied to an electronic sewing machine will be described with reference to FIGS. 1 to 17. As shown in FIGS. 1 to 3, an electronic sewing machine 1 of the present embodiment has a bed 2, a pillar 3 standing on the right end of the bed 2, an arm 4 extending leftward from the upper end of the pillar 3. A plurality of switches such as a start-stop switch 7 are provided on a front surface of the arm 4, in addition to a large type liquid crystal display 8.

Provided on the bed 2 are a feed dog vertically moving mechanism (not shown) that vertically moves the feed dog and a feed dog longitudinally moving mechanism (not shown) that longitudinally moves the feed dog, a loop-taker hook (for example, a horizontal hook) that accommodates a lower thread bobbin and that works cooperatively with a sewing needle 19, and the like.

A vertically oriented needle bar base 10 that vertically movably supports the needle bar 18 is arranged inside the head 5 of the arm 4, and the upper end of the needle bar base 10 is swingably supported by a pivot shaft 11 fixed to a machine frame F. Furthermore, the arm 4 is provided with needle bar vertically moving mechanism 13 that vertically drives the needle bar 18, a needle bar swinging mechanism (not shown) that swings the needle bar 18 in the direction perpendicular to the cloth feeding direction, a thread take-up vertically moving mechanism (not shown) that vertically moves the thread take-up in synchronization with the vertical movement of the needle bar 18, and the like.

A brief description will be given to a needle bar vertically moving mechanism 13 which is provided in the head 5. As shown in FIGS. 2 to 3, a needle bar crank 15 is fixed on a distal end of a sewing machine main shaft 14, and a crank rod 16 is rotatably provided on the needle bar crank 15. The needle bar 18 is fixed on a needle bar clamp 17 connected to the crank rod 16.

At the time of sewing, when the sewing machine main shaft 14 is driven by a sewing machine motor 110 (refer to FIG. 15), the needle bar 18 is vertically driven via the needle bar crank 15, the crank rod 16, and the needle bar clamp 17 by the rotation of the sewing machine main shaft 14. Stitches are then formed on a workpiece cloth by a loop-taker hook.

Next, a unitized needle threading device 20 that threads an upper thread 9 to a needle eye 19*a* of the sewing needle 19 which is detachably attached to the lower end of the needle bar 18 is described.

As shown in FIGS. 2, 3, 6, and 7, on the rear surface side of the needle bar base 10, a vertically oriented needle threading shaft 21 is arranged adjacent to the needle bar 18. The needle threading shaft 21 is vertically movably and rotatably supported by a plurality of support portions 10*a* and 10*b* formed on a needle bar base 10. A vertically oriented operation shaft 22 arranged adjacent to the needle threading shaft 21 is also vertically movably supported by a plurality of support portions 10*a* and 10*b*.

Next, a hook mechanism 30 which has a needle threading hook 32 and is fixed to a lower end of the needle threading shaft 21 will be described with reference to FIGS. 3 to 7, 10, 12A, and 12B. A hook retaining member 31 made of synthetic resin is secured on the lower end of the needle threading shaft 21. The hook retaining member 31 has upper and lower ends and the needle threading shaft 21 includes two portions corresponding to the upper and lower ends of the retaining member 31 respectively. A second thread guide member 26 which is substantially C-shaped has upper and lower supporting walls 26*a* and 26*b* pivotally mounted on the aforesaid portions of the threading shaft 21 corresponding to the upper and lower ends of the retaining member 31 respectively. Thus, the second thread guide member 26 is pivotally mounted on the needle threading shaft 21.

The second thread guide member 26 includes a vertically disposed thread guide wall 26*c* which connects the upper and lower supporting walls 26*a* and 26*b* thereof. The thread guide wall 26 is formed with a second thread guide portion 26*d* that engages and guides the upper thread 9 and a thread introducing portion 26*e* that introduces the upper thread 9 to the second thread guide portion 26*d*. Furthermore, a plate-shaped thread guiding mechanism 70 specific to the present invention is provided on the thread guide wall 26*c*, which will be described later.

Figure 5:
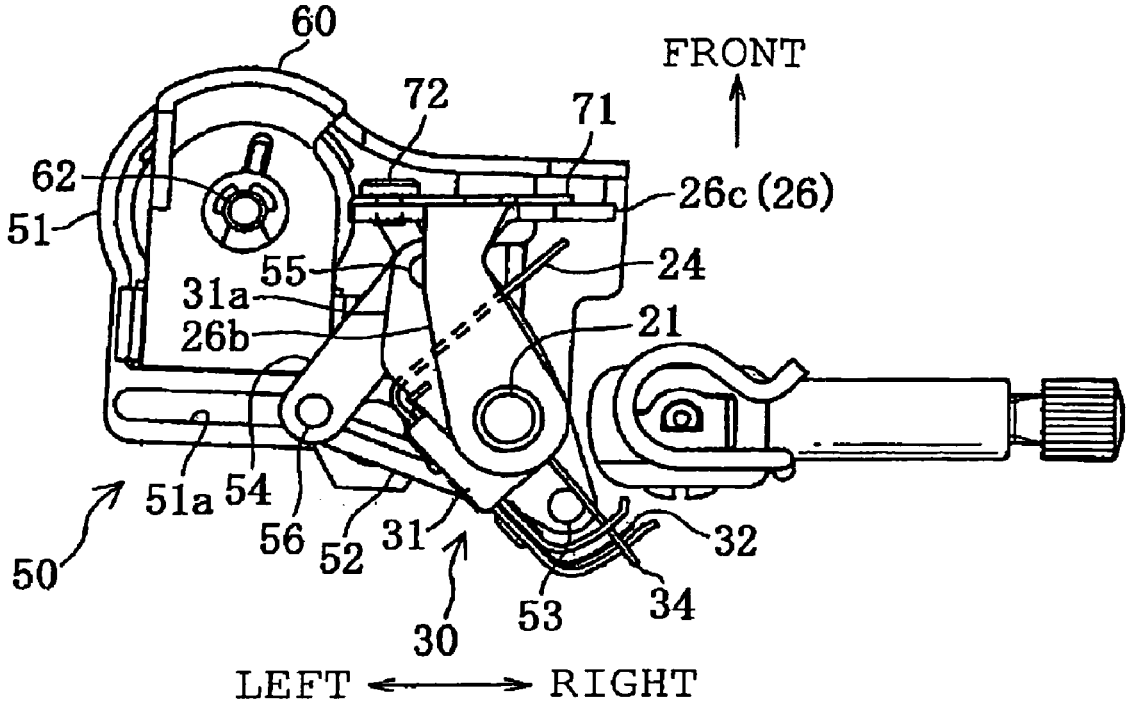
FIG. 5 is a bottom view of the needle threading device.
Figure 7:
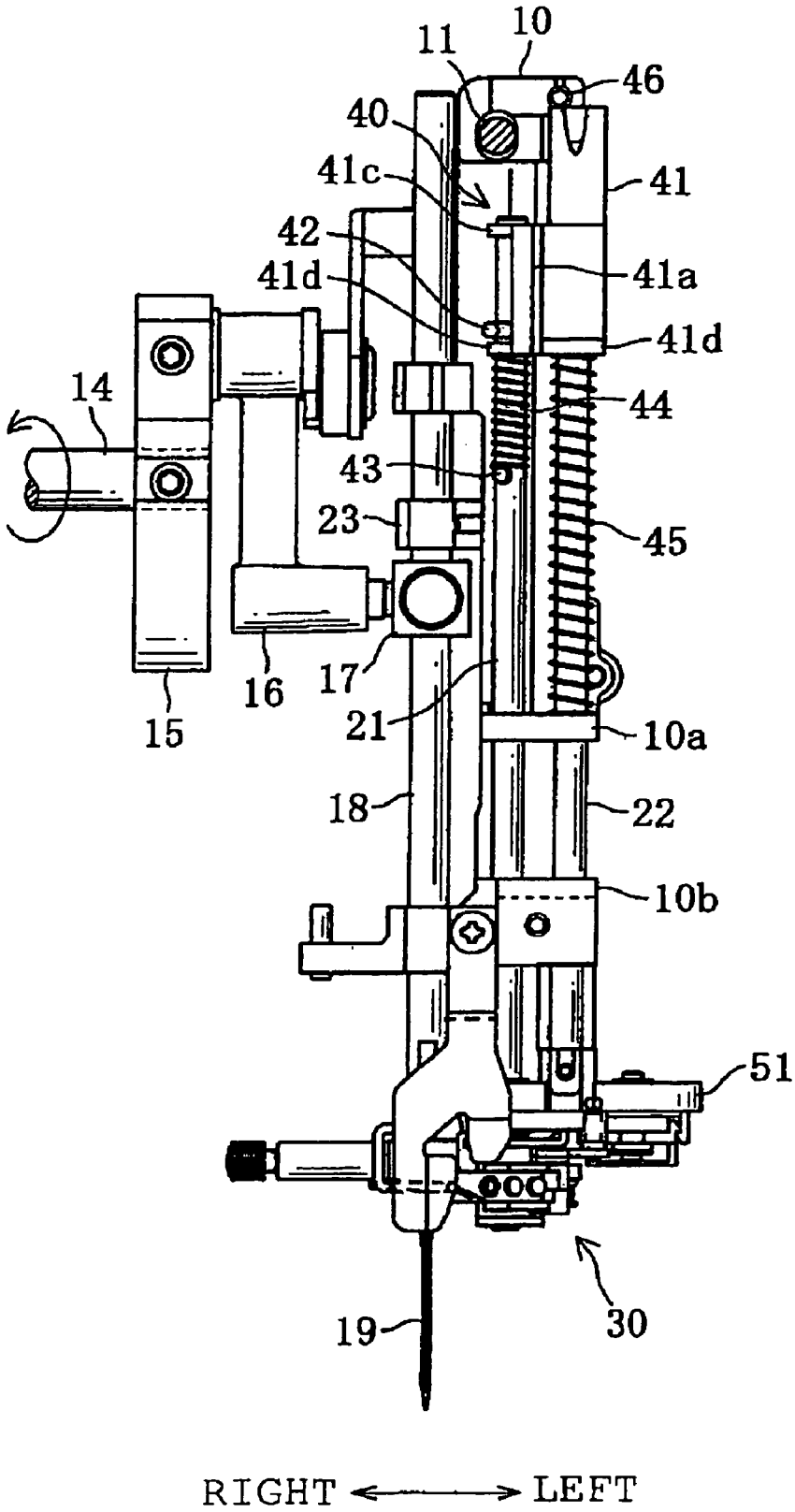
FIG. 7 is a rear view of the needle threading device.
Figure 9:
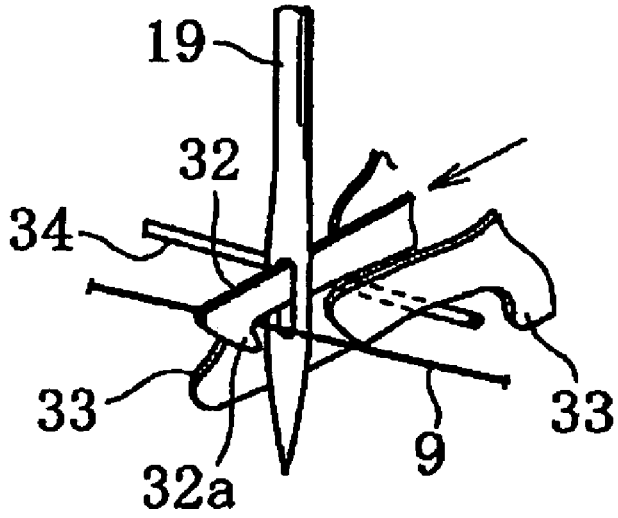
FIG. 9 is a view similar to FIG. 8, showing the needle threading hook passed through a needle eye of the sewing needle.

As shown in FIGS. 5, 7 and 9, the hook mechanism 30 is fixed to the hook retaining member 31. The hook mechanism 30 includes a needle threading hook 32, two guide members 33 located on both sides of the needle threading hook 32, and a thread retaining wire 34 made of elastic material horizontally penetrating the needle threading hook 32 and the guide members 33.

Figure 8:
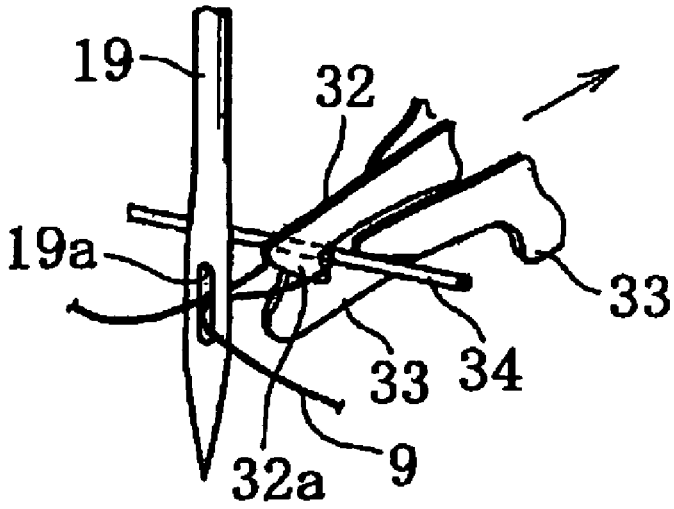
FIG. 8 is a partial perspective view of a needle threading hook and a sewing needle.

A hook 32*a* is formed on the end of the needle threading hook 32 as shown in FIG. 8. At the time of needle threading which will be described later, as shown in FIG. 9, the upper thread 9 which is guided by the aforementioned guide members 33 and is located immediately in front of the needle eye 19*a* is hooked by the hook 32*a* inserted through the needle eye 19*a* of the sewing needle 19.

Figure 4:
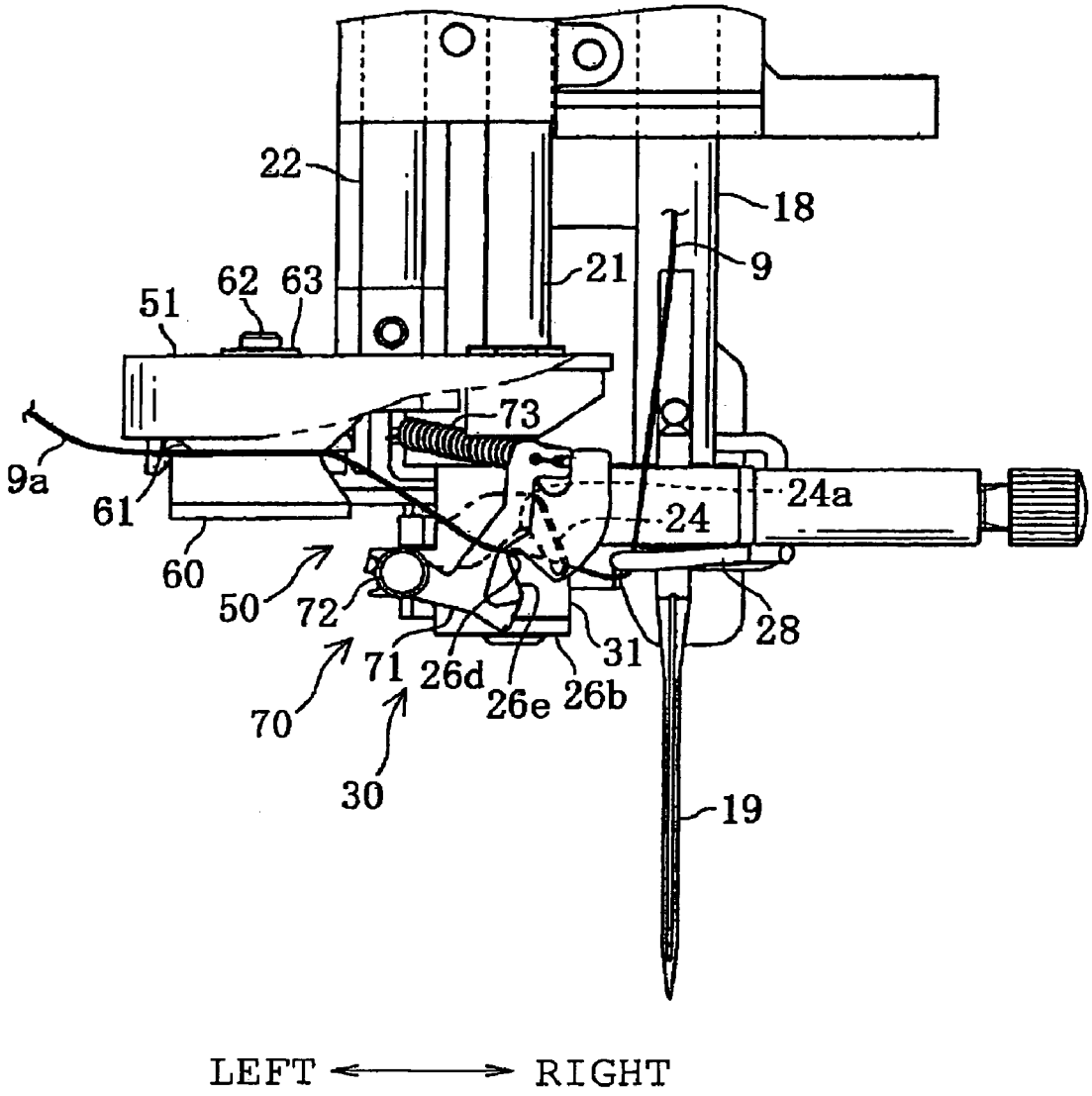
FIG. 4 is a partially enlarged front view of the lower end of the needle threading device.
Figure 6:
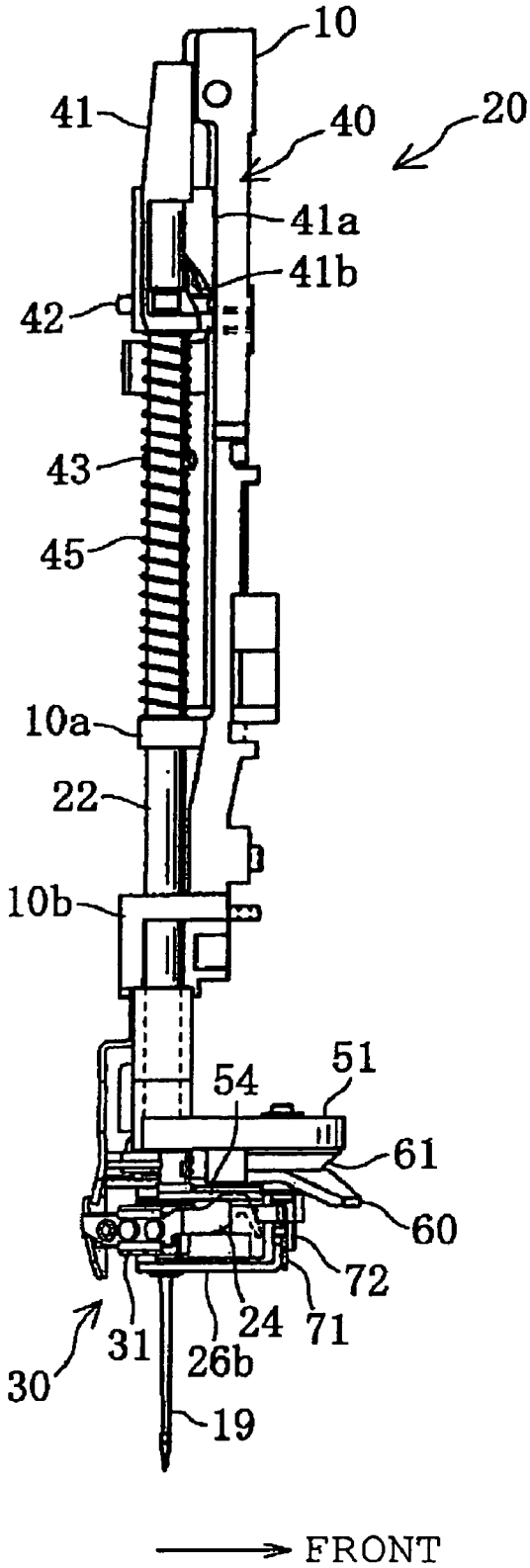
FIG. 6 is a left side view of the needle threading device.

As shown in FIGS. 4 to 6, a first thread guide member 24 is integrally fixed to the hook retaining member 31. The substantial tip of the first thread guide member 24 is bent downward functioning as a first thread guide portion 24*a*. The first thread guide portion 24*a* is located substantially to the opposite of the hook-mechanism 30 with respect to the needle threading shaft 21, and is separated from the hook mechanism 30 by a predetermined distance. That is, the first thread guide member 24 and the hook mechanism 30 maintain a predetermined distance between each other and are integrally provided on the needle threading shaft 21.

Next, a rotational drive mechanism 40 will be described. The rotational drive mechanism 40 rotates the needle threading shaft 21 by a predetermined angle at the time of needle threading. As shown in FIGS. 6 and 7, an operation body 41 made of synthetic resin is inserted vertically movably into the upper end of the needle threading shaft 21 and operation shaft 22 which are disposed rear surface side of the needle bar base 10. An outer periphery wall 41*a* corresponding to substantially half of the outer periphery of the upper end of the needle threading shaft 21 is formed on the operation body 41, as shown in FIG. 6. A spiral pivot groove 41*b* is formed on the outer periphery wall 41*a*. A slide pin 42 of a predetermined length is fixed in a penetrating manner near the upper end of the needle threading shaft 21, more specifically in a location corresponding to the immediate upper side of the lower pivot portion 41*d* of a vertical pair of pivot portions 41*c* and 41*d* of the operation body 41. An inner end of the slide pin 42 is engaged in the pivot groove 41*b*. The needle threading shaft 21 is spaced a predetermined distance below the slide pin 42. A spring mounting pin 43 is fixed to the needle threading shaft 21 so as to penetrate the shaft.

A compression coil spring 44 is fitted on the needle threading shaft 21, more specifically in the portion between the lower pivot portion 41*d* of the operation body 41 and the spring mounting pin 43. Furthermore, a compression coil spring 45 is fitted on the operation shaft 22, more specifically in the portion between the lower pivot portion 41*d* of the operation body 41 and the upper support portion 10*a* of the needle bar base 10. That is, the needle threading shaft 21 and the operation shaft 22 are normally located via the operation body 41 in a retracted position which is an upper most position shown in FIGS. 2, 3, 6, and 7 by the abutment of the upper end of the operation body 41 to a horizontally-oriented engagement pin 46 fixed to the needle bar base 10, caused by the spring force of the compression coil spring 45.

A needle threading operation lever 47 (corresponding to a needle threading operation member) will be described hereinafter. As shown in FIG. 2, both vertical ends of a vertically oriented lever shaft 48 are supported by the machine frame F of the head 5. An operation portion 47*a* of a needle threading operation lever 47 is exposed to the left side of the head 5 via a vertically oriented slit 5*a* formed in the machine frame F of the head 5. A link portion of the needle threading operation lever 47 is linked to a part of the operation body 41 and the needle threading operation lever is normally on standby at the upper standby position indicated by a solid line.

A needle threading detection switch 49 (refer to FIG. 15) which is activated in conjunction with the lowering operation of the needle threading operation lever 47 when the user lowers the needle threading operation lever 47 from the standby position in order to perform the needle threading operation is provided. Therefore, when the user lowers the needle threading operation lever 47, the needle threading detection switch 49 is turned ON, and tension is applied to the upper thread 9 hooked on a later described thread tension regulator 81 of a thread tension mechanism 80. The needle threading operation lever 47, needle threading detection switch 49, and the like constitute the needle threading operation unit.

By lowering the needle threading operation lever 47, the operation body 41 is simultaneously lowered in resistance to the spring force of the compression coil spring 45. At this point, the lower most position of the needle threading shaft 21 is located at a predetermined height of the needle bar 18. That is, since a locating member 23 that renders the needle threading hook 32 to be leveled with the height of the needle eye 19*a* of the sewing needle 19 is fixed, the needle threading shaft 21, the operation shaft 22 and the operation body 41 are lowered simultaneously until the slide pin 42 abuts the locating member 23.

Figure 10:
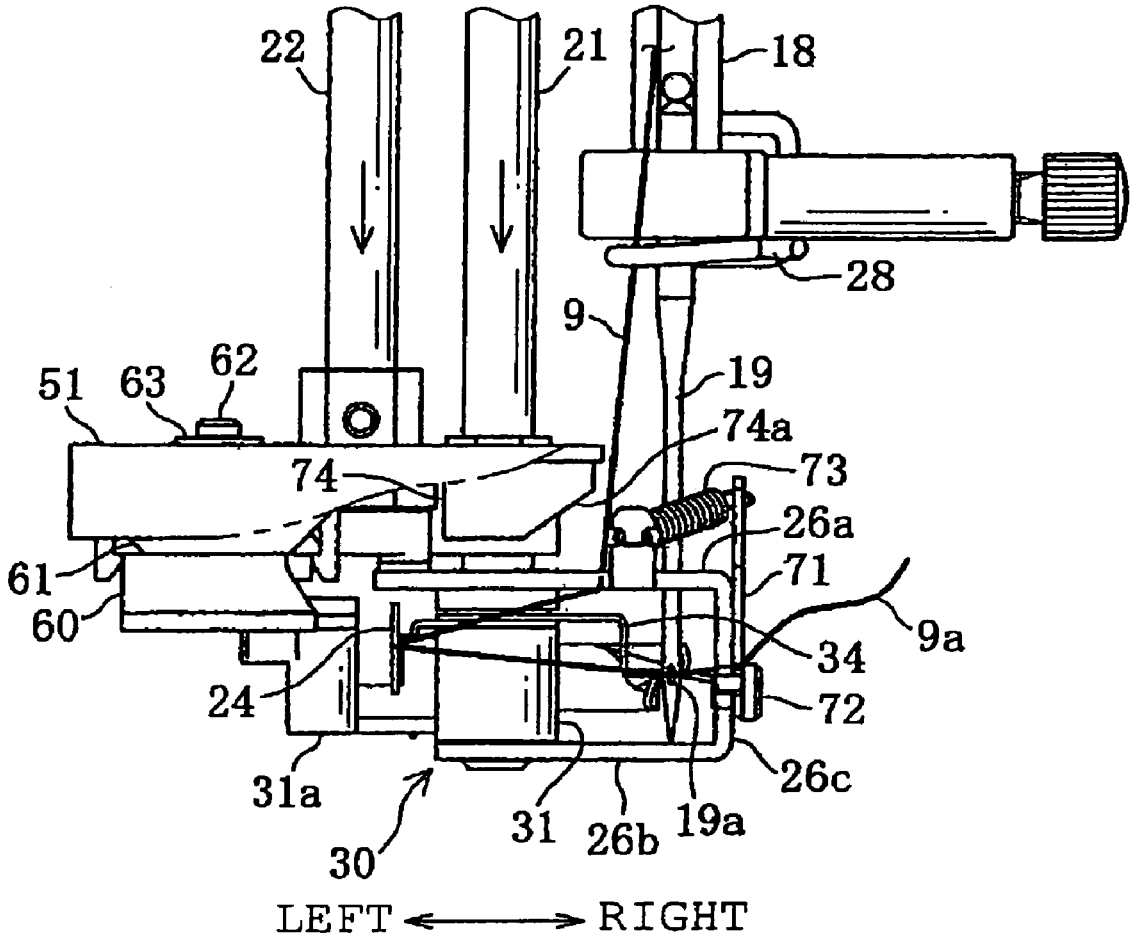
FIG. 10 is a view similar to FIG.4, showing a needle threading shaft lowered to the lower most position.
Figure 11A:
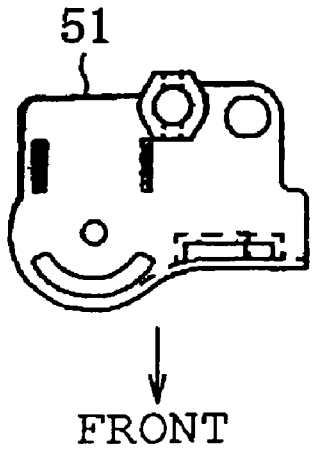
FIG. 11A is a flat view of a link guide member.
Figure 11B:
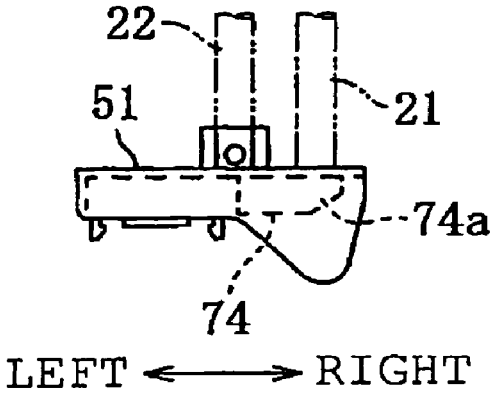
FIG. 11B is a front view of the link guide member.
Figure 11C:
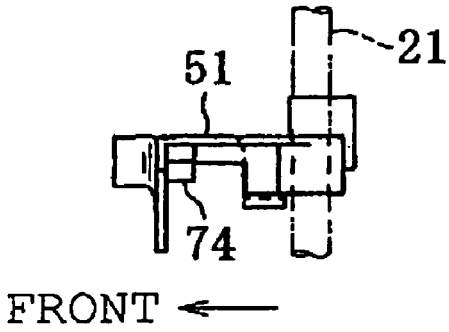
FIG. 11C is a right side view of the link guide member.

Then, in case the operation body 41 is further lowered, the slide pin 42 abuts the locating member 23 from above disabling any further descent and in case the needle threading shaft 21 is lowered to the lower most position shown in FIG. 10, the operation body 41 alone is lowered. Thus the slide pin 42 is rotated by a predetermined angle in clockwise direction in flat view by the pivot groove 41*b* at the height where the slide pin 42 abuts the locating member 23.

That is, the needle threading shaft 21 is rotationally driven; the hook mechanism 30 is rotated in the direction that approaches the sewing needle 19; and at the same time, the first thread guide member 24 is rotated in synchronization with the hook mechanism 30 in clockwise direction, that is, in the direction that moves away from the sewing needle 19. At this point, since the upper thread 9 hooked across the first thread guide member 24 and the second thread guide member 26 is placed in the horizontal orientation immediately in front of the sewing needle 19; as shown in FIG. 9, the needle threading hook 32 passes through the needle eye 19*a* and hooks the upper thread 9.

Then, the hook mechanism 30 is rotated in the reverse direction by the upward movement of the needle threading operation lever 47, whereupon the needle threading hook 32 is pulled out with the upper thread 9 hooked Thus, the upper thread 9 is threaded.

Next, a link mechanism 50 will be described hereinafter. At the time of needle threading, the link mechanism 50 rotates the second thread guide member 26 supported rotatably in the lower end of the needle threading shaft 21 in the direction moving away from the first thread guide member 24. As shown in FIGS. 4, 5, and 11A to 11C, a link guide member 51 in a substantially oblong form in flat view includes a rear end which is secured to the lower end of the operation shaft 22 in a horizontal state. The needle threading shaft 21 is rotatably inserted into a penetrating hole formed in the rear-right end of the link guide member 51.

A straight and laterally oriented sliding groove 51*a* is formed on the rear end of the lower surface of the link guide member 51. The right end of a first link 52 is rotatably linked by a pin 53 to the upper supporting wall 26*a* in the upper side of the second thread guide member 26. The front end of a second link 54 is rotatably linked by a pin 55 to the link portion 31*a* protruding to the front of the hook retaining member 31. Furthermore, the left end of the first link 52 and the rear end of the second link 54 are rotatably linked via a slide pin 56, and the upper end of the slide pin 56 is movable in the direction to which the groove is formed by being engaged to the sliding groove 51*a*.

That is, when the needle threading shaft 21 is on standby after having been lowered and just before being rotated for needle threading, the second thread guide member 26 is located in a front-faced stand-by position, and the first thread guide portion 24*a* of the first thread guide member 24 is located in the immediate inner side of the second thread guide portion 26*d* of the second thread guide member 26, as shown in FIGS. 2 and 5.

When the needle threading shaft 21 rotates after being lowered to the lower most position, the hook mechanism 30 and the first thread guide member 24 are integrally rotated clockwise in flat view, and at the same time, the second thread guide member 26 is rotated approximately 90 degrees counterclockwise from the stand-by position via the link mechanism 50. That is, the second thread guide member 26 moves away from the first thread guide member 24, and approaches the hook mechanism 30.

As shown in FIGS. 2 to 3, 5, and 7, a support plate 60 is fixed to the left front-end portion of the lower surface of the link guide member 51. A first thread retaining member 61 is provided on the support plate 60 for retaining the upper thread end 9*a* with slight pressure generated from elastic force. That is, the lower end of the upward-oriented pivot pin 62 is fixed on the support plate 60, and the first thread retaining member 61 which is a presser disc is vertically movably supported on the pivot pin. 62, and the first retaining member 61 is arranged so as not to be removed from the pivot pin 62 by an e-ring 63. Furthermore, a compression coil spring (not shown) is fitted onto the pivot pin 62 placed in between the link guide member 51 and the first thread retaining member 61, and the first thread retaining member 61 is elastically biased so as to be pressed against the support plate 60 by a slight spring force of the compression coil spring.

As shown in FIG. 2, a thread cutter 65 for cutting the lower thread is provided on the machine frame F in the lower end of the head 5. Upon performing the needle threading operation, the upper thread 9 drawn from the thread spool (not shown) is sequentially hooked on the following portions that define a thread path: the thread tension regulator 81 which will be later described, the thread take-up, a thread take-up spring (not shown), a needle bar thread guide 28 mounted on the lower end of the needle bar 18, the first thread guide portion 24*a* of the first thread guide member 24, the second thread guide portion 26*d* of the second thread guide member 26, the first thread retaining member 61, and the support plate 60. Finally, by cutting the upper thread 9 which was hooked in the above manner by the thread cutter, the upper thread end 9*a* of the upper thread 9 is arranged to be retained by the first thread retaining member 61 with slight pressure.

The thread cutter 65 is provided relatively close to the first thread retaining member 61 so that the length of the upper thread 9 from the later described second thread guide member to the thread end cut by the thread cutter 65 becomes a length such that the thread end can be pulled out from the needle eye 19*a* by the returning movement of the needle threading hook 32.

The second thread guide portion 26*d* and a thread introducing portion 26*e* are formed continuously on the vertically disposed thread guide wall 26*c* of the second thread guide member 26, as shown in FIGS. 2 to 4 and 12B. The second thread guide portion 26*d* engages and guides the upper thread 9. The thread introducing portion 26*e* introduces the upper thread 9 to the second thread guide portion 26*d*. Furthermore, a thread retaining mechanism 70 and a helical extension spring 73 are provided in the thread guide wall 26*c*. The thread retaining mechanism 70 has a second thread retaining member 71 (corresponding to a thread retaining member). The second thread retaining member 71, the helical extension spring 73 and the like constitute a thread retaining unit.

The thread retaining mechanism 70 will be described hereinafter. The second thread retaining member 71 comprises a metal plate formed into a substantial L-shape in front view. The second thread retaining member 71 is pivotally mounted, at a part thereof near to a corner thereof, on a support pin 71 further mounted on the lower left portion of the thread guide wall 26*c*. A thread retaining portion 71*b* is formed on the end of the horizontally-oriented short side 71*a* constituting the substantial L-shape. The helical extension spring 73 is coupled to a distal end of a vertically-oriented long side 71*c* constituting the substantial L-shape and to a spring hooking portion formed by bending one end of the upper support wall 26*a*, so as to be aslant.

Figure 17A:
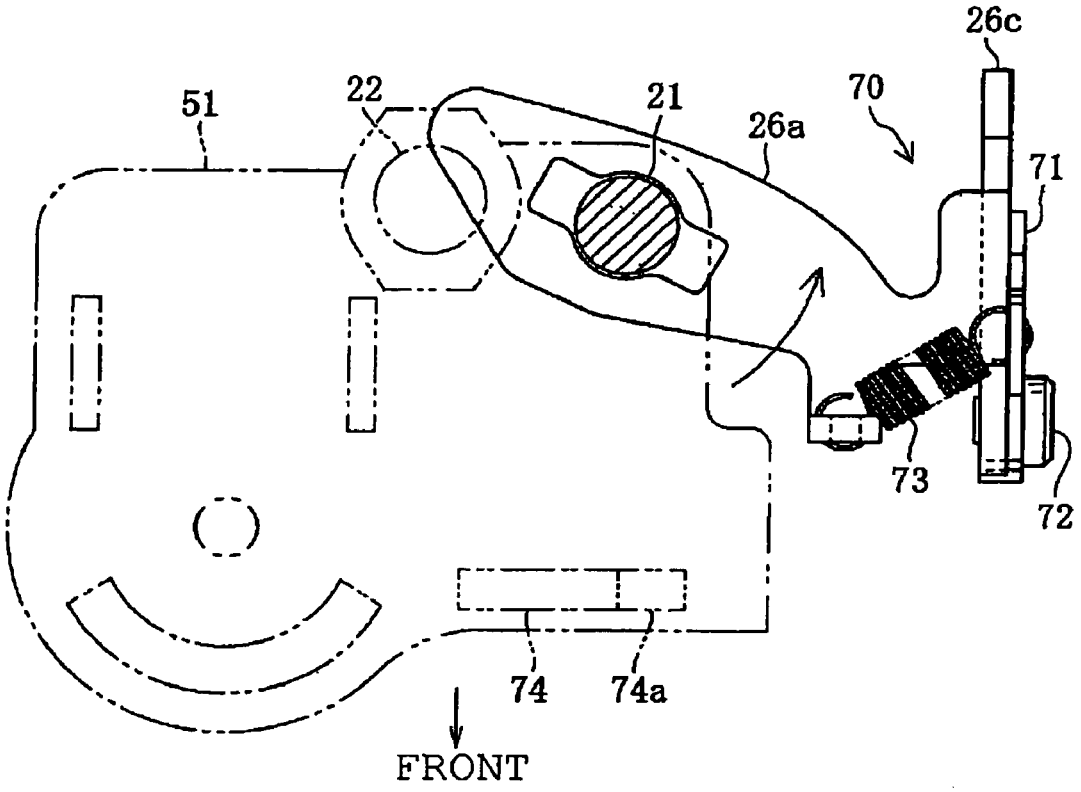
FIG. 17A is a flat view of the second thread guide member and thread retaining mechanism during needle threading process.
Figure 17B:
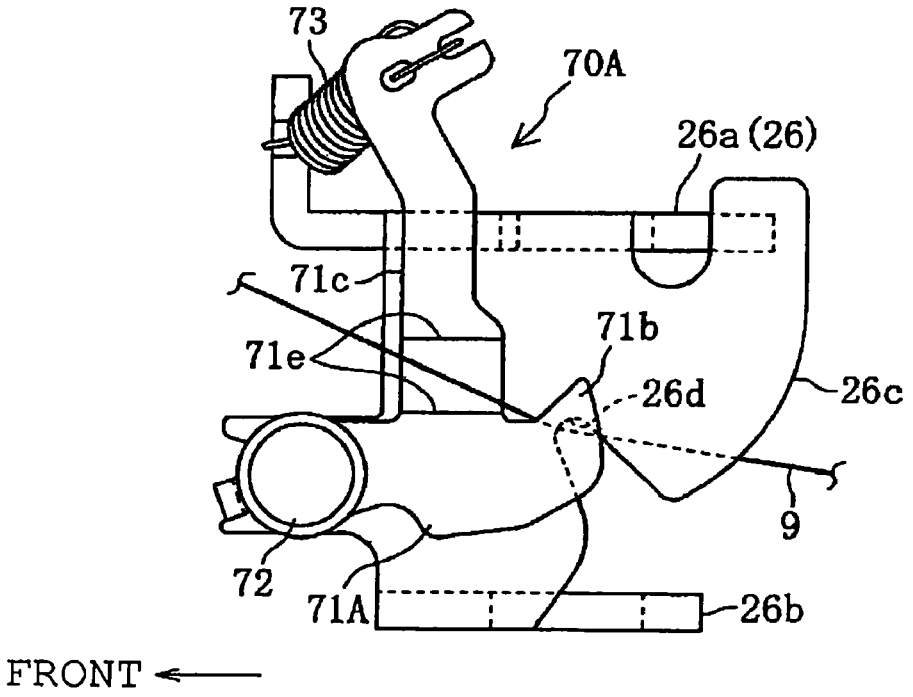
FIG. 17B is a front view of the second thread guide member and thread retaining mechanism during needle threading process.

Hence, the second thread retaining member 71 is biased by the helical extension spring 73 toward a closed position shown in FIG. 17B and also toward the direction in which the thread retaining portion 71*b* presses the second thread guide member 26. When located at the aforesaid closed position, the second thread retaining member 71 retains the upper thread 9 guided to the second thread guide portion 26*d* by closing the thread introducing portion 26*e* of the second thread guide member 26 in cooperation with the second thread guide member 26.

Figure 12A:
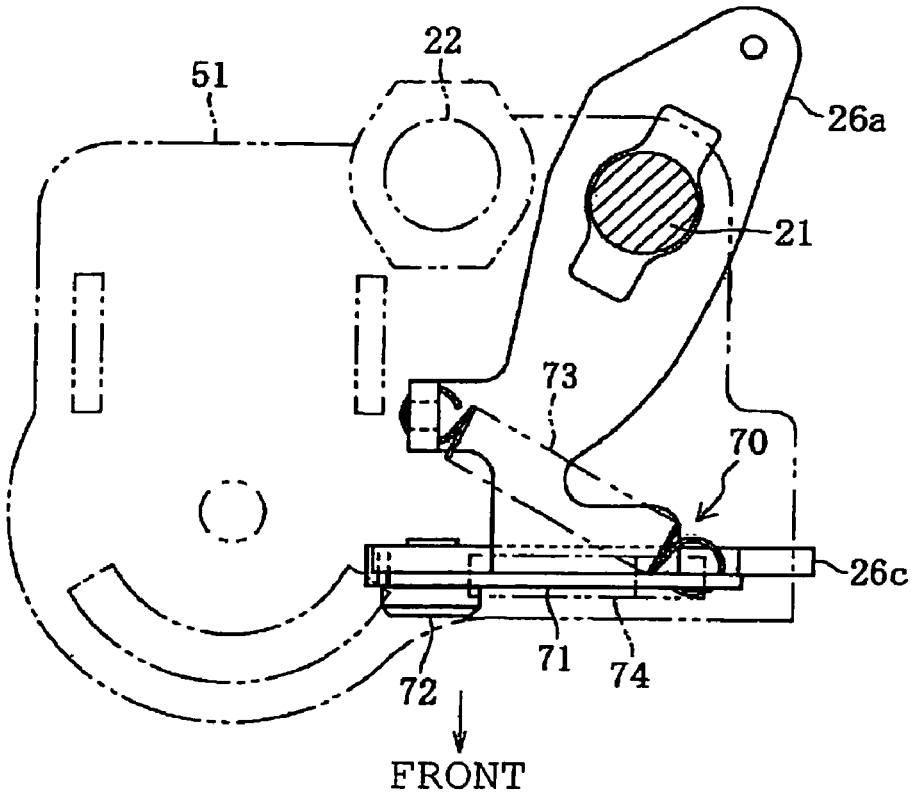
FIG. 12A is a flat view of a second thread guide member and a thread retaining mechanism before needle threading.
Figure 12B:
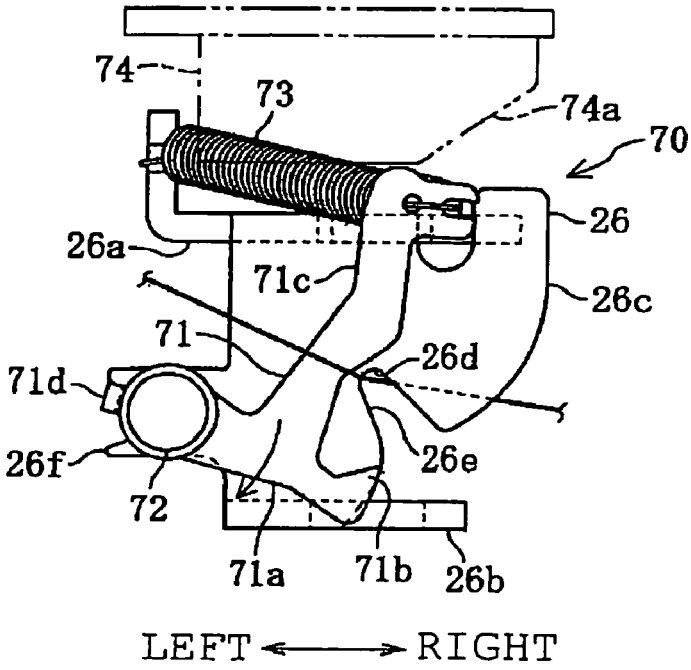
FIG. 12B is a front view of a second thread guide member and a thread retaining mechanism before needle threading.

However, as shown in FIGS. 12B and 17B, an engaging portion 71*d* formed as a protrusion on the end of the second thread retaining member 71 is fitted into a notch 26*f* formed on the second thread guide member 26. Therefore, when the second thread retaining member 71 is moved to the closed position, the engaging portion 71*d* contacts the lower surface of the notch 26*f* so as to be engaged, thereby locating the closed position of the second thread retaining member 71.

An open-close cam 74 having a sloped guide cam surface 74*a* is formed integrally on the lower surface of the link guide member 51 so as to protrude, more specifically, on the front end portion that corresponds to the distal end of the long side 71*c* of the second thread retaining member 71, when the second thread guide member 26 is located at a stand-by position. Therefore, as shown in FIG. 12A, when the second thread guide member 26 is in the stand-by position at the time of hooking the upper thread 9, since the distal end of the long side 71*c* is pressed downward by the guide cam surface 74*a*, the second thread guide retaining member 71 is disposed in the opened position.

However, at the time of needle threading, when the second thread guide member 26 starts rotating from the stand-by position towards the needle eye 19*a*, as shown in FIG. 17B, the second thread guide member 71 moves to the closed position by the spring force of the helical extension spring 73. At this point, the upper thread 9 guided to the second thread guide portion 26*d* is securely retained in cooperation with the second thread guide member 26 by the spring force of the helical extension spring 73.

Next, the thread tension mechanism 80 will be described hereinafter. The thread tension mechanism 80 is arranged in the arm 4 immediately to the right side of the needle threading device 20 and applies thread tension to the upper thread 9 drawn from the thread spool whenever applicable.

Figure 13:
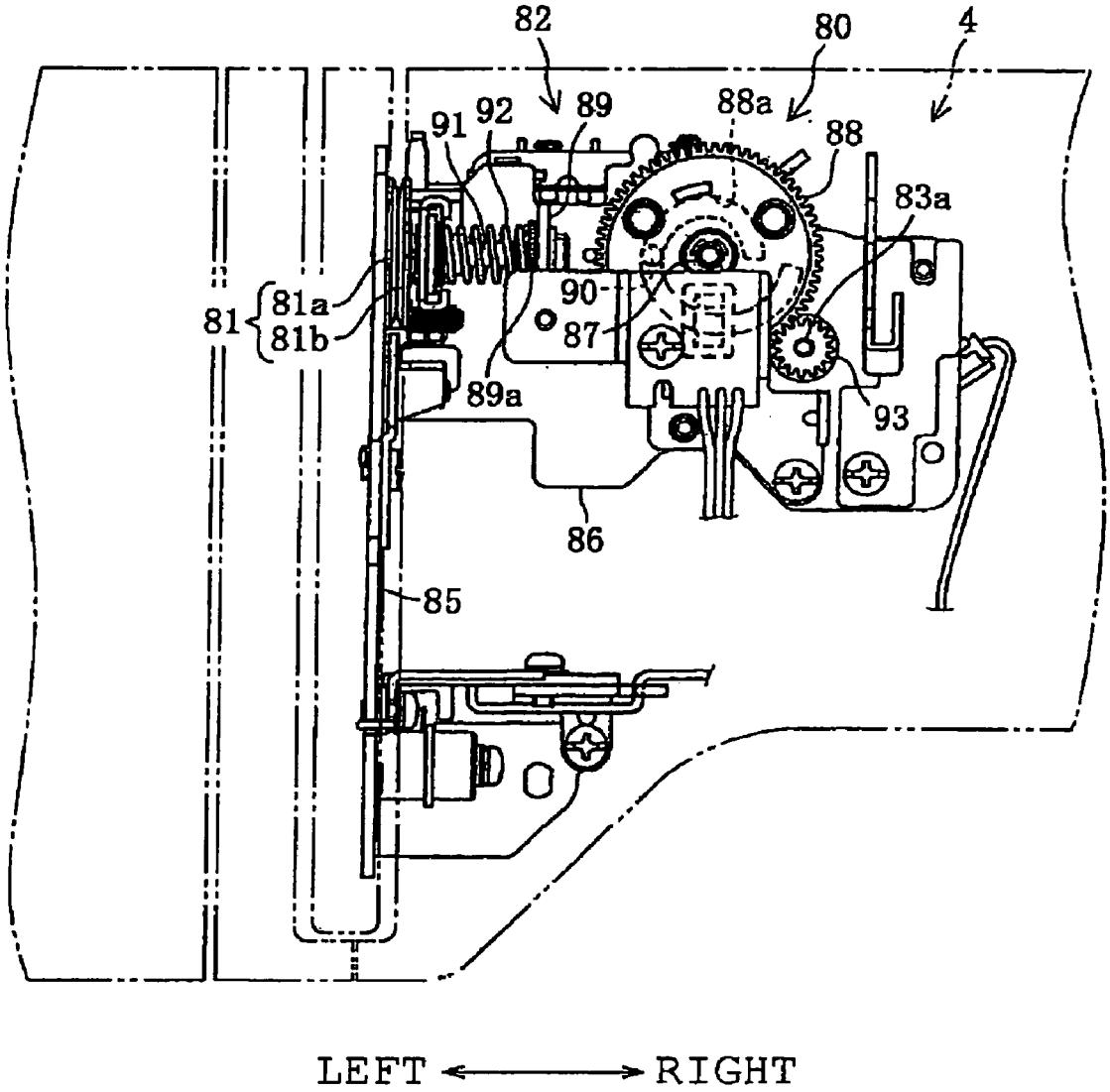
FIG. 13 is a front view of a thread tension mechanism.
Figure 14:
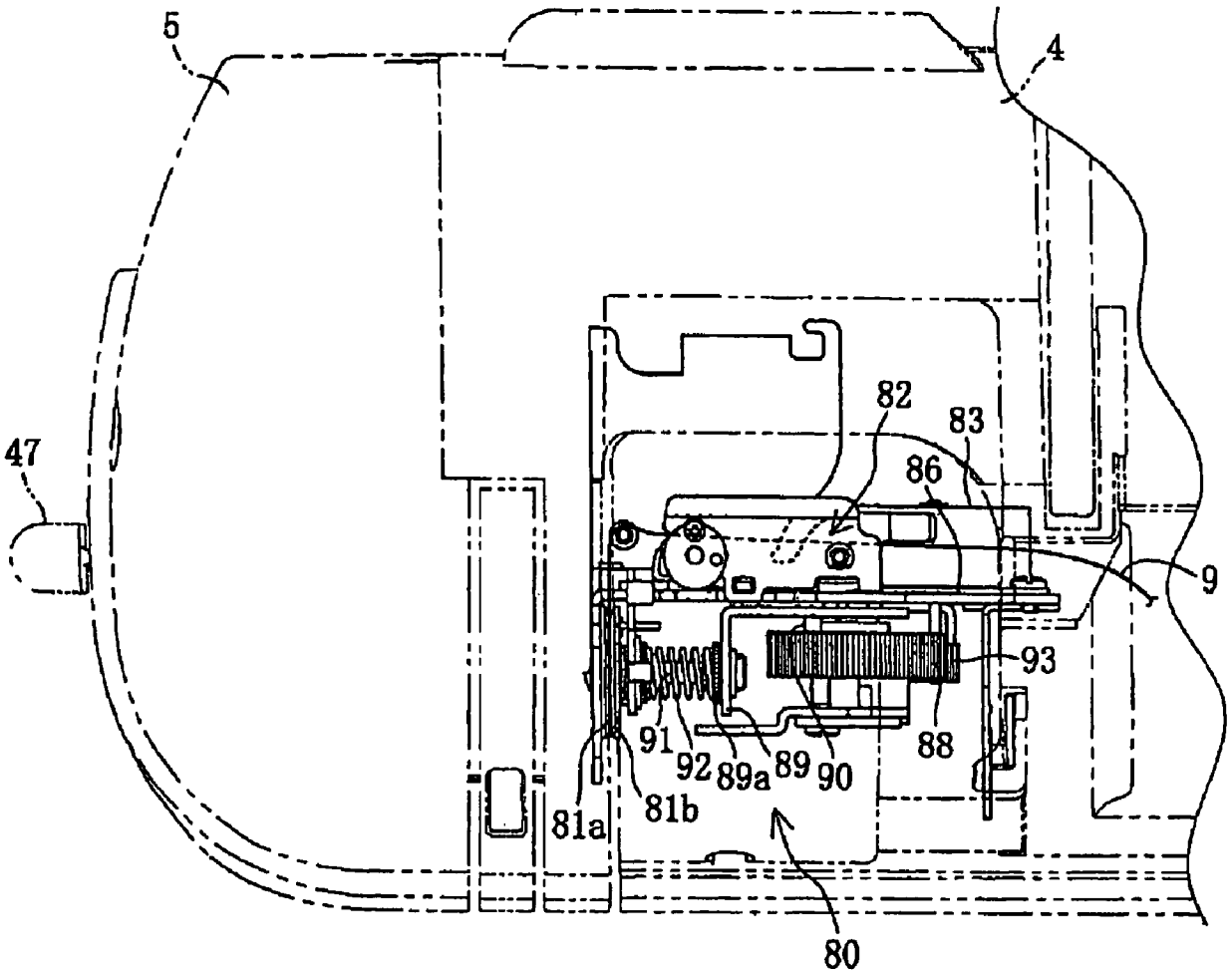
FIG. 14 is a flat view of a thread tension mechanism.

As shown in FIGS. 13 and 14, the thread tension mechanism 80 adjusts the thread tension by clamping the upper thread 9. The thread tension mechanism is constructed by a pair of thread tension discs 81*a* and 81*b* serving as the thread tension regulator 81 that applies appropriate thread tension to the upper thread 9; a tension adjustment mechanism 82 that variably adjusts the spring force of the compression coil spring 92 which presses the movable thread tension disc 81*b* against the fixed thread tension disc 81*a*; and a thread tension motor 83 that activates the tension adjustment mechanism 82 in order to clamp the upper thread 9 for thread tension adjustment.

The tension adjustment mechanism 82 will be described hereinafter. On the upper end portion of a longitudinally oriented and vertically elongated guide frame 85, a vertically oriented mounting plate 86 is fixed. On a longitudinally oriented pivot shaft 87 fixed to the mounting plate 86, a circular tension adjustment gear 88 is rotatably pivoted. A spiral cam 88*a* is recessed in the rear side of the tension adjustment gear 88, and to the spiral cam 88*a*, a forward oriented engagement pin 90 which is fixed to a thread tension plate 89 in an L-shape in flat view is engaged. A cylindrical spring mounting member 89*a* is fixed to the thread tension plate 89.

The right end of the thread tension shaft 91 fixed to the guide frame 85 is fitted into the spring mounting member 89*a* from the left side. A compression coil spring 92 is provided about the thread tension shaft 91 interposed between the moveable thread tension disc 81*b* and the spring mounting member 89*a*. The fixed thread tension disc 81*a* is mounted to the guide frame 85 in a fixed manner.

The rear side of the thread tension motor 83 is fixed to the mounting plate 86. A drive gear 93 is fixed on a drive shaft 83*a* penetrating the mounting plate 86, and the tension adjustment gear 88 is in mesh-engagement with the drive gear 93. Therefore, when the thread tension motor 83 is driven, the tension adjustment gear 88 is rotatably driven via the drive gear 93, consequently generating the lateral movement of the thread tension plate 89 via the engagement pin 40 engaged to the spiral cam 88*a*.

The more the thread tension plate 89 moves to the right, the smaller the spring force of the compression coil spring 92 becomes. Hence, the pressure between the thread tension discs 81*a* and 81*b* is reduced. The tension generated by the two thread tension discs 81*a* and 81*b* is gradually reduced, and eventually, after reaching "zero" thread tension, the thread tension discs 81*a* and 81*b* become "opened" in which the thread tension discs 81*a* and 81*b* are separated. As opposed to this, the more the thread tension plate 89 moves to the left, the greater the spring force of the compression coil spring 92 becomes. The tension generated by the thread tension discs 81*a* and 81*b* is increased and the tension of the upper thread 9 is gradually increased.

Figure 15:
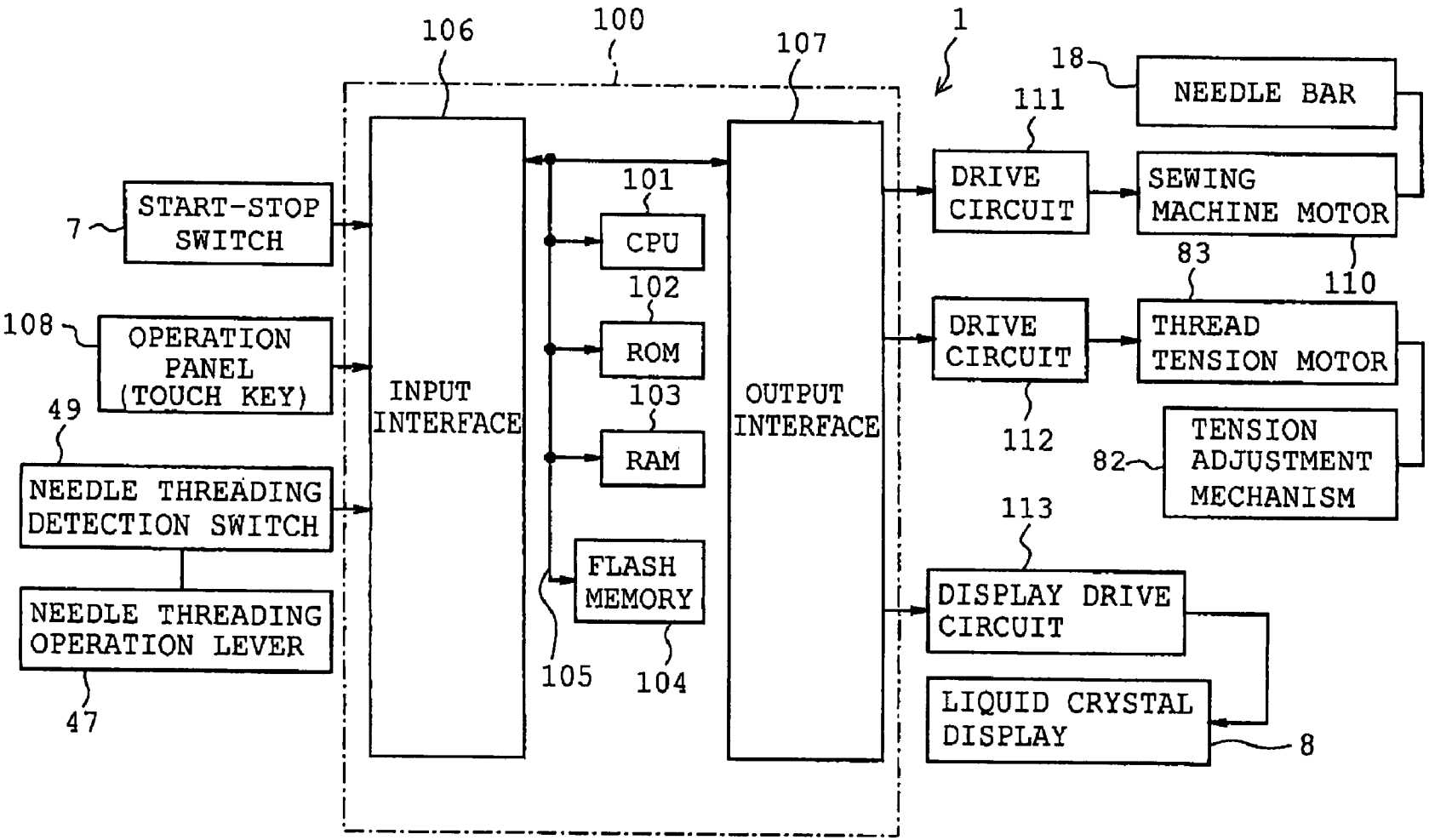
FIG. 15 is a block diagram of a control system of the electronic sewing machine.

Next, the outline of a control system for the electronic sewing machine 1 will be described based on a control block diagram in FIG. 15. A control device 100 (corresponding to a thread tension control unit) is configured by a microcomputer which includes a CPU 101, a ROM 102, a RAM 103, a flash memory 104; an input interface 106; an output interface 107; and the like that are connected to the microcomputer via a bus 105 such as a data bus.

Connected to the input interface 106 are the start-stop switch 7, an operation panel 108 having touch keys, the needle threading detection switch 49, and the like. Connected to the output interface 107 are a drive circuit 111 for the sewing machine motor 110 that vertically drives the needle bar 18, a drive circuit 112 for the thread tension motor 83 that activates the tension adjustment mechanism 82, a display drive circuit 113 for a liquid crystal display 8, and the like.

The ROM 102 stores: utility stitch data for a plurality types of utility patterns; a sewing control program that forms stitches by drive controlling the sewing machine motor 110 based on the utility stitch data; a control program that controls thread tension setting control performed at the time of needle threading described thereinafter, and the like. The RAM 103 is provided with: a stitch data memory that stores the loaded utility stitch data; various types of buffers, in addition to various types of work memory that temporarily store calculation results of the CPU 101; and the like.

Next, the operation of such constructed needle threading device 20 will be described hereinafter. First, at the time of needle threading, in case the needle bar 18 is moved to the substantially uppermost position, as shown in FIGS. 12A and 12B, since the second thread guide member 26 is in the stand-by position, the second thread retaining member 71 is disposed in the opened position.

In such state, the upper thread 9 drawn from the thread spool, as described earlier, is sequentially hooked onto a thread path defined by the following: the tension regulator 81 of the thread tension mechanism 80; the thread take-up and the take-up spring which are not shown; the needle bar thread guide 28; the first guide portion 24*a* of the first thread guide member 24; the second thread guide portion 26*d* of the second thread guide member 26; and the first thread retaining member 61.

Finally, the thread end 9*a* of the upper thread 9 cut by the thread cutter 65 is retained by slight pressure by the first thread retaining member 61. Since the first thread guide portion 24*a* is located immediately to the inner side of the second thread guide portion 26*d*, upon hooking the upper thread 9, by merely hooking the upper thread 9 to the second thread guide portion 26*d* in the outer side, the thread can also be hooked on the first thread guide portion 24*a* of the first thread guide member 24 as well at the same time.

Next, upon manual lowering of the needle threading operation lever 47 by the user, the needle threading shaft 21 and the operation shaft 22 are simultaneously lowered to the lower most position (refer to FIG. 10). At this point, as described earlier, since the needle threading detection switch 49 is turned ON, the needle threading control indicated in FIG. 16 is executed.

Figure 16:
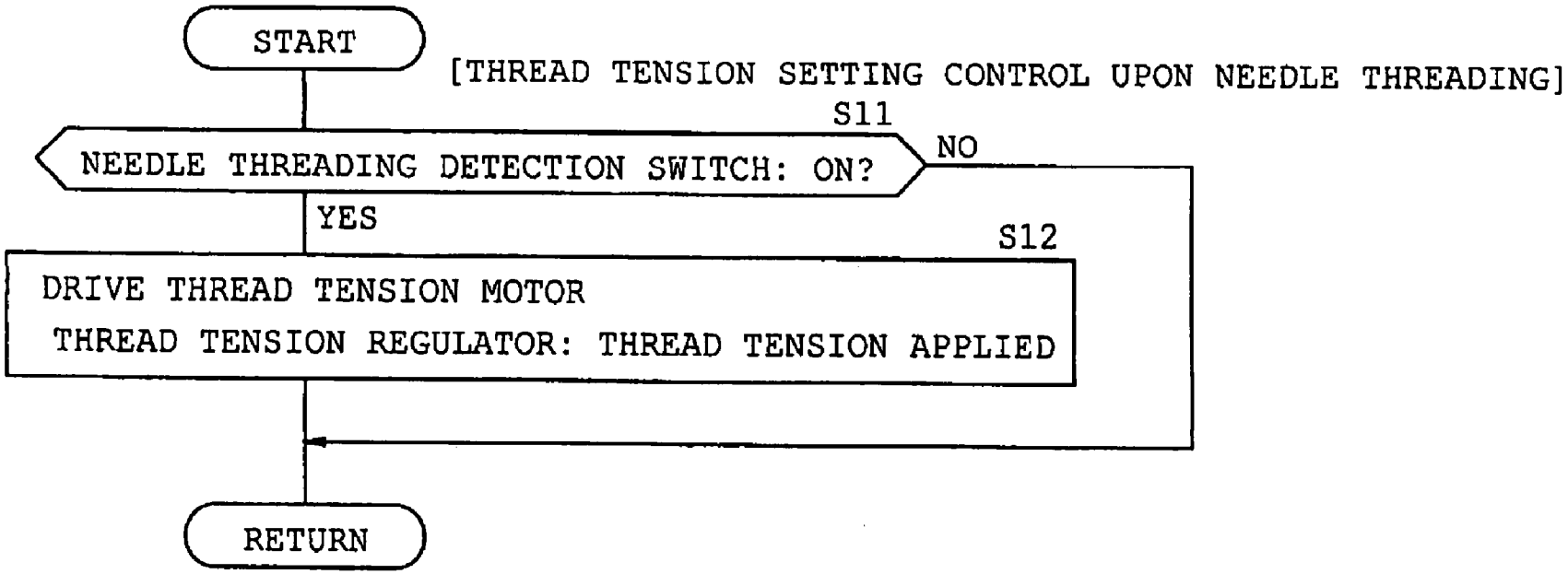
FIG. 16 is a flow chart of a thread tension setting control performed upon needle threading.

The thread tension setting control executed upon needle threading by the control device 100 of the electronic sewing machine 1 is described based on the flow chart in FIG. 16. It needs to be noted that thread tension setting control is repeatedly executed in small time intervals and that symbols Si (i=11, 12) in the figures indicate each step.

When thread tension setting control is started and the needle threading detection switch 49 is not ON in accordance with the detection signal sent from the needle threading detection switch 49, that is, the needle threading operation lever 47 is not lowered (S11: No), the process is immediately terminated, and the control is returned to the main control. However, in case the needle threading detection switch 49 is turned ON, and the needle threading operation lever 47 is lowered for the purpose of needle threading (S11: Yes), the thread tension motor 83 is driven, and the thread tension regulator 81 is set to a predetermined thread tensioned state (S12) via the tension adjustment mechanism 82.

Thus, since the thread tension set to a predetermined value is operated on the upper thread 9 by the thread tension regulator 81 at the time of needle threading, drawing of the upper thread 9 from the thread spool is reliably prevented. That is, the upper thread amount required for lowering the first and the second thread guide members 24 and 26, which are disposed in the lower end of the needle threading shaft 21, to the lower most position (refer to FIG. 10) can be secured by pulling back the thread end 9*a* of the upper thread retained by the first thread retaining member 61 in the direction opposite of the thread supplying direction.

At this point, as described earlier, since a part of the upper thread 9 from the second thread retaining member 71 to the thread end 9*a* is relatively short, the thread end has been moved near the first thread retaining member 61. Then, the needle threading operation lever 47 is further lowered and the slide pin 42 of the needle threading shaft 21 is rotated by a predetermined angle (for example, approximately 90 degrees) in the needle threading direction via a rotating mechanism 40 at the height where the slide pin 42 of the needle threading shaft 21 abuts the locating member 23.

At this point, as described earlier, as shown in FIGS.17A and 17B, since the second retaining member 71 is moved from the opened position to the closed position by the helical extension spring 73, the upper thread 9 guided to the second thread guide portion 26*d* is retained cooperatively with the thread retaining portion 71*b* of the second thread retaining member 71.

As a result, as described earlier, when the hook mechanism 30 is rotated in the direction that approaches the sewing needle 19, the second thread guide member 26 is also rotated at the same time to the direction that approaches the sewing needle 19, with the thread end 9*a* of the upper thread 9 retained by the second thread retaining member 71. Hence, the thread end 9*a* of the upper thread 9 is pulled out of the first thread retaining member 61.

Furthermore, when the needle threading hook 32 is passed through the needle eye 19*a*, the first thread guide member 24 is rotated clockwise at the same time in synchronization with the hook mechanism 30 in the direction moving away from the sewing needle 19. Furthermore, the second thread guide member 26 is moved away from the first thread guide member 24 via the link mechanism 50 and is moved to approach the hook mechanism 30.

That is, as shown in FIG. 10, the upper thread 9 is hooked in a substantially zigzag state in flat view by the first thread guide portion 24*a* of the first thread guide member 24 and the second thread guide portion 26*d* of the second thread guide member 26. Then, by the rotation of the second thread guide member 26 in the direction towards the sewing needle 19, the upper thread amount required for needle threading operation (refer to FIG. 9) to be performed by the needle threading hook 32 is further drawn via the second thread guide member 26 in the direction opposite of the thread supplying direction.

At this point, the portion of the upper thread 9 used for needle threading which is hooked across from the first thread guide portion 24*a* of the first thread guide member 24 to the second thread guide portion 26*d* of the second thread guide member 26 is disposed immediately in front of the needle threading hook 32 in a stretched manner. Such portion of the upper thread 9 is guided, as shown in FIG. 8, by the guide members 33 to the position that can be engaged to the needle threading hook 32. Then the upper thread 9 is hooked by the needle threading hook 32 that has passed through the needle eye 19*a* of the sewing needle 19.

After that, when the user releases his/her hand from the needle threading operation lever 47, the operation body 41 is raised at once by the spring force of the compression coil spring 45, upon which the first thread guide member 24, the second thread guide member 26, and the hook mechanism 30 are rotated back to the original position via the rotating mechanism 40 and the link mechanism 50. Then, the second thread retaining member 71 is moved to the original opened position.

As a result, the needle threading hook 32 is pulled out and moved away from the needle eye 19*a* with the upper thread 9 hooked consequently passing the needle through. At this point, since the upper thread 9 is retained by the thread retaining wire 34, the upper thread 9 does not fall off from the needle threading hook. After that, when the needle threading shaft 21 is raised, the thread retaining wire 34 is released so as to remove the upper thread 9 from the needle threading hook 32, and the upper thread end 9*a* of the upper thread 9 is reliably pulled out in the reward direction from the needle eye 19*a*.

Thus, the first thread guide 24 and the second thread guide 26 are provided in the needle threading device 20 of the electronic sewing machine 1 having the needle threading shaft 21, the needle threading hook 32, and the rotary mechanism 40. The second thread guide member 26 has the second thread guide portion 26*d* that guides the upper thread 9 at the time of hooking the upper thread 9 and the thread retaining mechanism 70 that retains the upper thread 9 guided to the second thread guide portion 26*d*. Therefore, the second thread guide member 26 and the thread retaining mechanism 70 cooperatively retain the thread end 9*a* of the upper thread 9 near the needle eye from the moment when the second thread guide member 26 approaches needle threading hook 32 in an attempt to thread the needle until the needle threading hook 32 passes through the needle eye 19*a* in the advancing direction to hook the upper thread disposed immediately in front of the needle eye 19*a* and pulls out the upper thread 9 from the needle eye 19*a*. Hence, needle threading can be reliably performed even if the length of thread end 9*a* required for needle threading is short.

Also, the second thread guide member 26 is provided with the thread introducing portion 26*e* that introduces the upper thread 9 to the second thread guide portion 26*d*. The thread retaining mechanism 70 has the second thread retaining member 71 which is movable from the opened position and the closed position. The opened position opens the thread introducing portion 26*e* and enables the hooking of the upper thread 9 to the thread introducing portion 26*e*, and the closed position closes the thread introducing portion 26*e* and retains the upper thread 9 introduced to the second thread guide portion 26*d* in cooperation with the thread guide member 26. The thread retaining mechanism 70 is also provided with the helical extension spring 73 that bias the second thread retaining member 71 to the closed position. Therefore, when hooking the needle thread 9 at the time of needle threading, the second thread retaining member 71 is moved to the opened position and the upper thread 9 can be hooked from the thread introducing portion 26*e* to the second thread guide portion 26*d* of the second thread guide member 26.

On the other hand, at the time of needle threading, since the second thread retaining member 71 is moved to the closed position by the bias of the helical extension spring 73, the upper thread 9 guided to the second guide portion 26*d* can be reliably retained by the cooperation of the second thread retaining member 71 and the second thread guide member 26.

Also, the second thread retaining member 71 is constructed to be disposed in the opened position when the second thread guide member 26 is in the stand-by position at the time of hooking the upper thread 9, and to be disposed in the closed position when the second thread guide member 26 starts the rotation from the stand-by position towards the needle eye 19*a*. Therefore, when the second thread guide 26 is in the stand-by position at the time of hooking the upper thread 9, the second thread retaining member 71 is moved to the opened position, and when the second thread guide member 26 starts rotating for needle threading, the second thread retaining member 71 is moved to the closed position. That is, the second thread retaining member 71 can be opened and closed conjunctively with the position to which the second thread guide member 26 is moved.

Also, the thread retaining portion 71*b* that retains the upper thread 9 cooperatively with the second thread guide member 26 is provided in the second thread retaining member 71 Furthermore, the helical extension spring 73 is arranged to operate bias in the direction to move the second thread retaining member 71 to the closed position, as well as the direction to press the thread retaining portion 71*b* towards the second thread guide member 26. Therefore, by the biasing force of a single helical extension spring 73, the second thread retaining member 71 can be moved to the closed position, as well as reliably retaining the upper thread 9 by the thread retaining portion 71*b* of the second thread retaining member 71 and the second thread guide member 26 regardless of the thickness of the upper thread 9.

Next, modified forms (second to fifth embodiments) of the above embodiment will be described hereinafter.

Figure 18A:
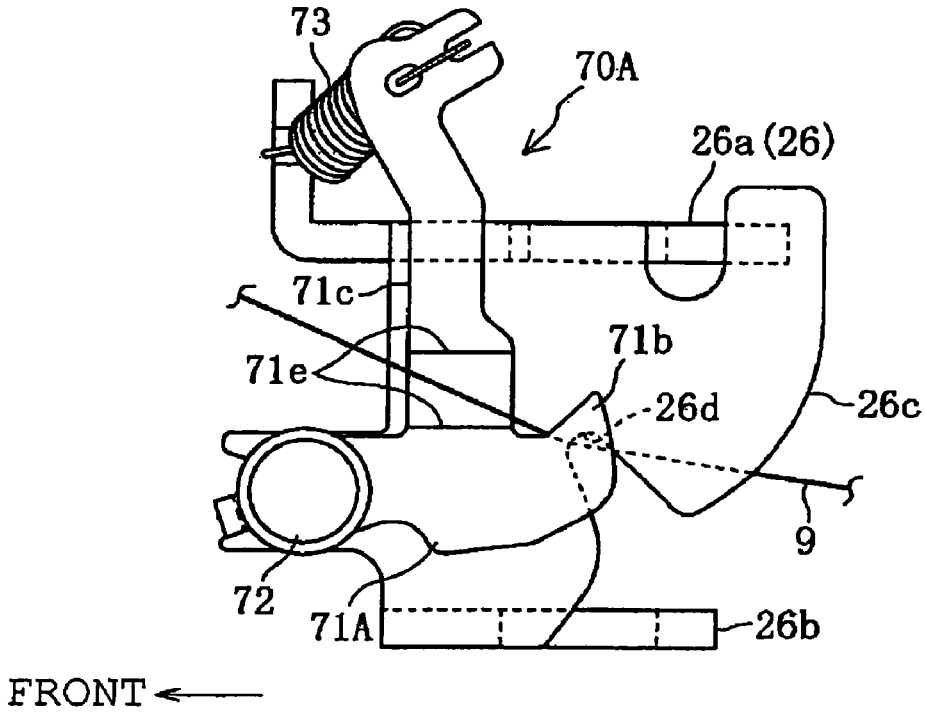
FIG. 18A is a front view of the second thread guide member and thread retaining mechanism during needle threading process according to a second illustrated aspect.
Figure 18B:
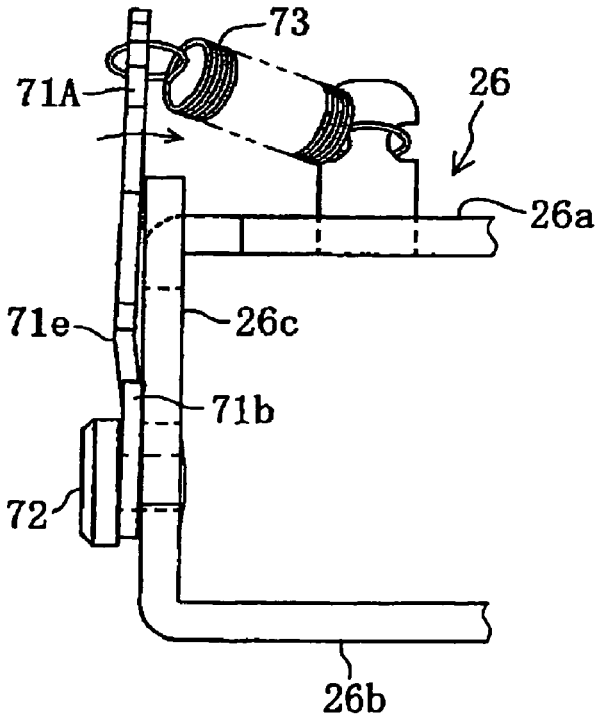
FIG. 18B is a side view of the second thread guide member and thread retaining mechanism during needle threading process.

1) The FIGS. 18A and 18B illustrate the second embodiment of the present invention. As shown in FIGS. 18A and 18B, a thread retaining mechanism 70A is constructed substantially the same as the above described embodiment wherein a second thread retaining member 71A is pivoted on the second thread guide member 26 and the helical extension spring 73 that bias the second thread retaining member 71A to the closed position are provided. A bent portion 71*e* bent in 2 steps in the horizontal direction is formed in the lower portion of the long side 71*c* of the second retaining member 71A. The helical extension spring 73 is arranged to bias the second thread retaining member 71A to the direction of the closed position, as well as the direction to press the second thread retaining member 71A against the second thread guide member 26.

In this case, the substantial upper half portion of the long side 71*c* is, though slightly, spaced apart from the second thread guide member 26. Hence, when the second thread guide member 71A is pressed toward the second thread guide member 26 by the helical extension spring 73, the thread retaining portion 71*b* is securely pressed to the second thread guide member 26 as to be in close contact therewith. Thus the capacity to retain the upper thread 9 by the thread retaining portion 71*b* of the second retaining member 71A can be improved.

Figure 19A:
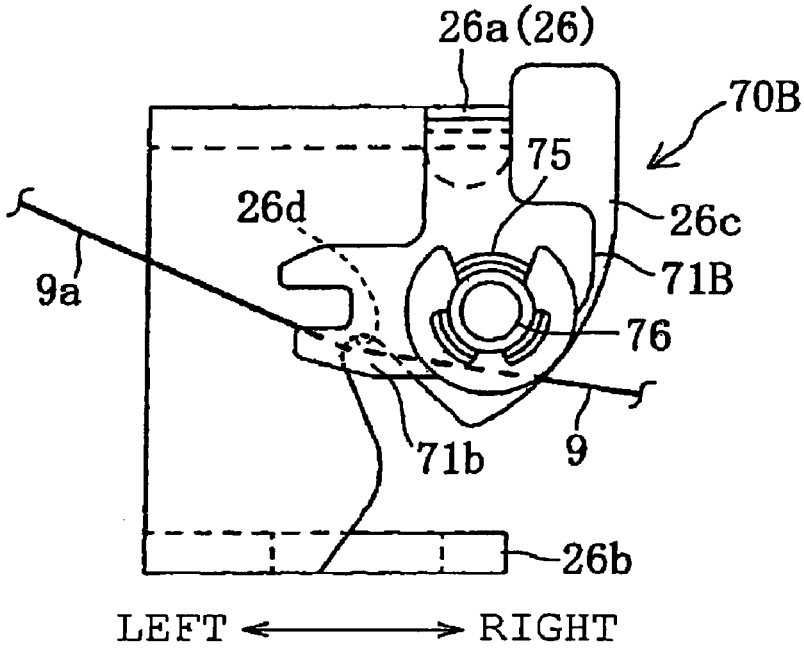
FIG. 19A is a front view of the second thread guide member and thread retaining mechanism during needle threading process according to a third illustrative aspect.
Figure 19B:
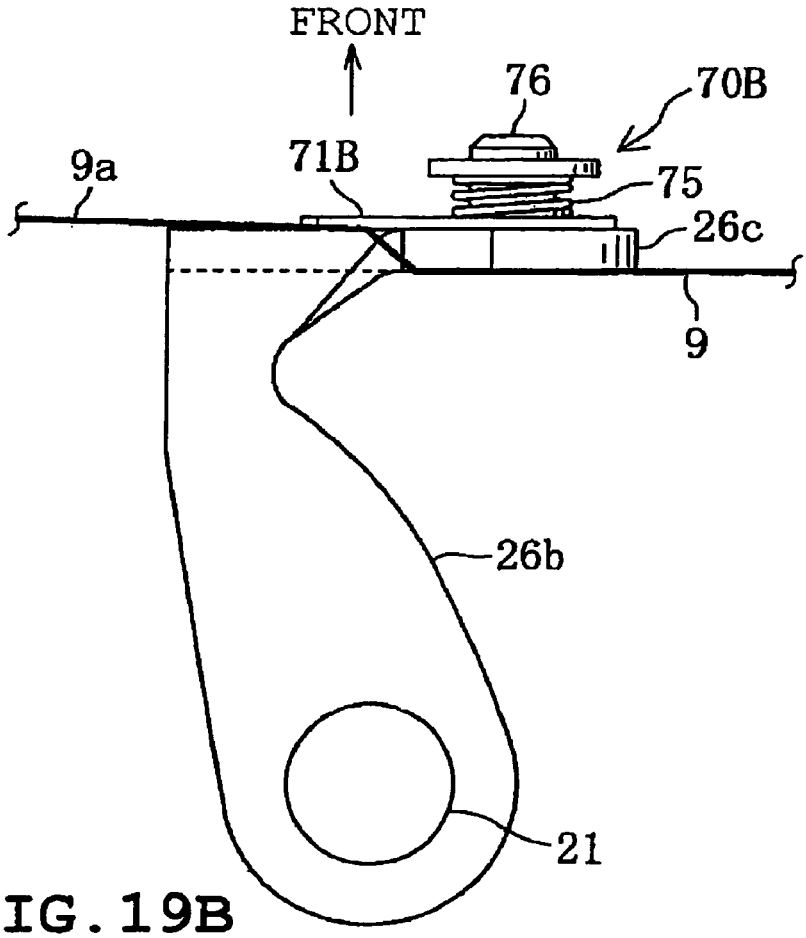
FIG. 19B is a bottom view of the second thread guide member and thread retaining mechanism during needle threading process.

2) FIGS. 19A and 19B illustrate a third embodiment of the present invention. As shown in FIGS. 19A and 19B, the thread retaining mechanism 70B has a second thread retaining member 71B made of a metal plate member that retains the upper thread 9 guided to the second thread guide portion 26*d* of the second thread guide member 26, and a coil spring 75 (corresponding to a biasing member) that elastically bias the second thread retaining member 71B in the direction to press the second thread guide member 26.

In such construction, the lower end of the second thread retaining member 71B close to the thread retaining portion 71*b* is biased towards the second thread guide member 26 by the coil spring 75 fitted onto the spring mounting shaft 76 fixed to the second thread guide member 26. In this case, since the second thread retaining member 71B is pressed against the second thread guide member 26 by the coil spring 75, when the upper thread 9 is guided in between the thread retaining portion 71*b* and the second thread guide portion 26*d* of the second thread guide member 26, the capacity to retain the upper thread 9 guided to the second thread guide portion 26*d* can be stabilized regardless of the thickness of the upper thread 9.

Figure 20A:
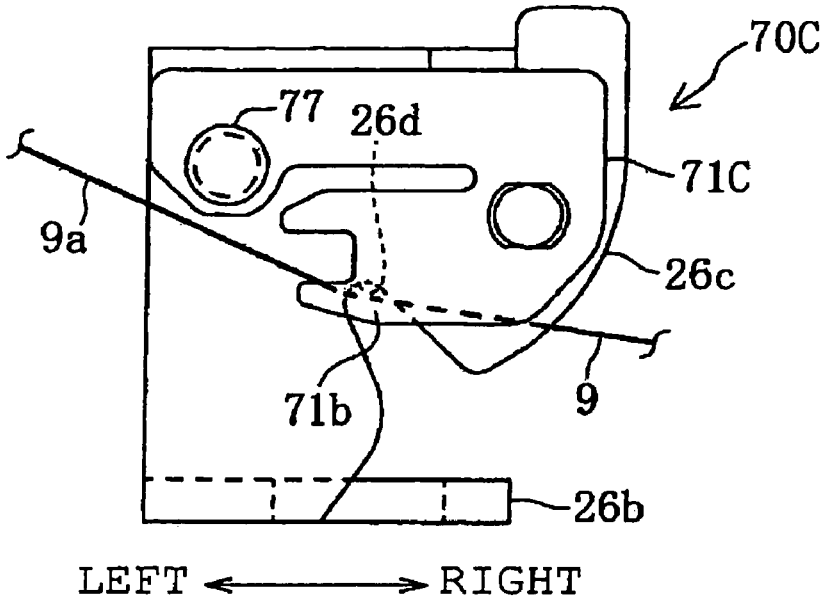
FIG. 20A is a front view of the second thread guide member and thread retaining mechanism during needle threading process according to a fourth illustrative aspect.
Figure 20B:
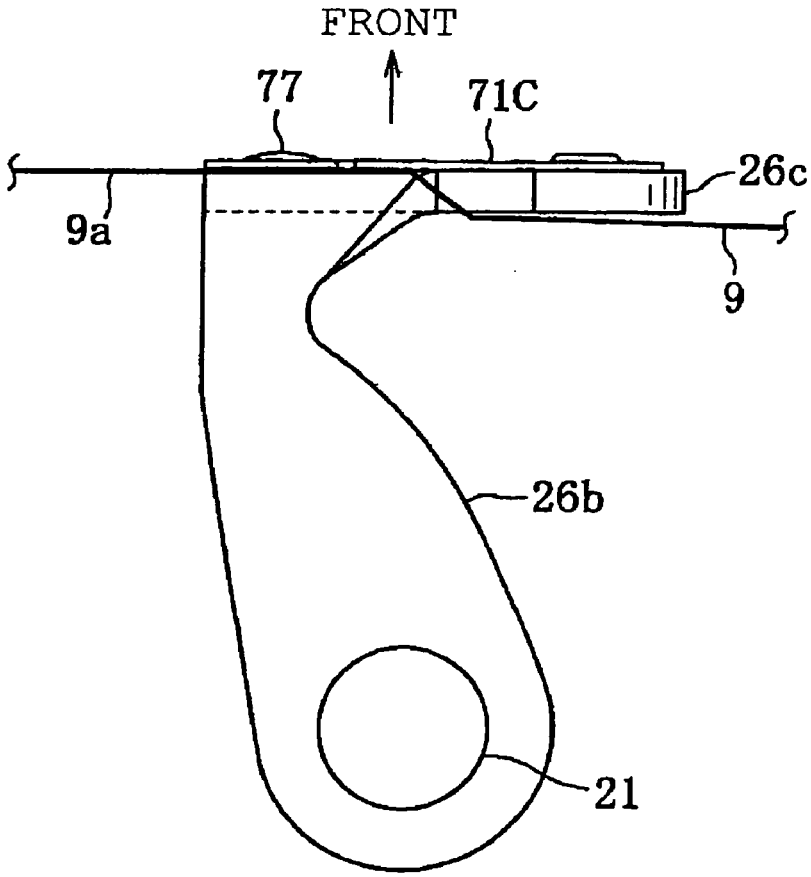
FIG. 20B is a bottom view of the second thread guide member and thread retaining mechanism during needle threading process.

3) FIGS. 20A and 20B illustrate a fourth embodiment of the present embodiment. As indicated in FIGS. 20A and 20B, the thread retaining mechanism 70C is provided with a second thread retaining member 71C which retains the needle thread 9 guided to the second thread guide portion 26*d* of the second thread guide member 26 and which is in a plate-form made of an elastic material that operates bias to the direction to press against the second thread guide member 26.

The second thread retaining member 71C made of elastic material is fixed by a screw 77 on one distal end thereof which is remote from the thread retaining portion 71*b*. In such construction, the mere provision of the second thread retaining member 71C made of elastic material to the second thread guide member 26 renders a reliable retention of the upper thread 9 guided to the second thread guide portion 26*d*. Also, the construction of the thread retaining mechanism 70C can be simplified which in turn improves the ease of assembly of the thread retaining mechanism 70*c*.

Figure 21A:
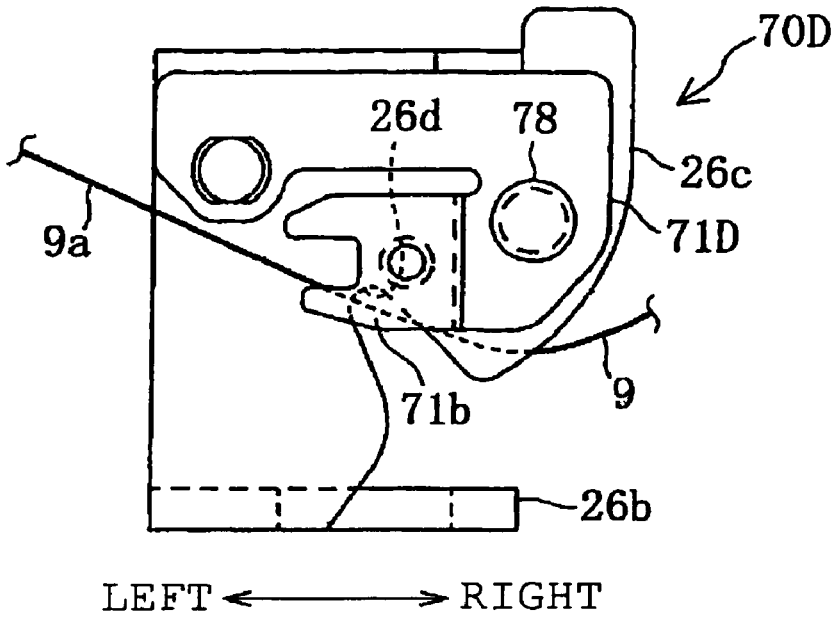
FIG. 21A is a front view of the second thread guide member and thread retaining mechanism during needle threading process according to a fifth illustrative aspect.
Figure 21B:
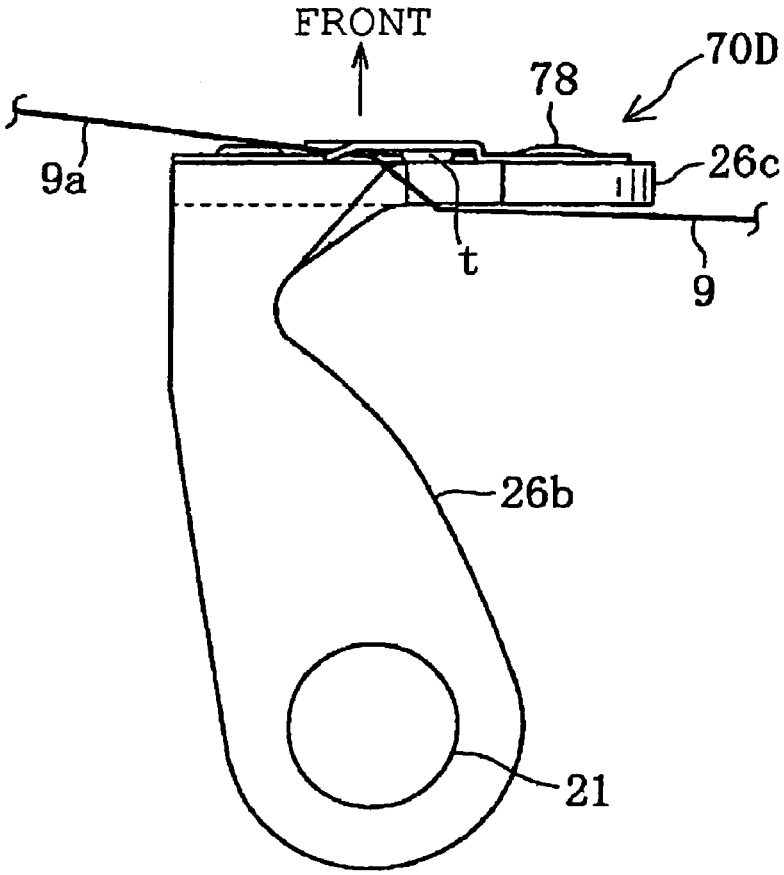
FIG. 21B is a bottom view of the second thread guide member and thread retaining mechanism during needle threading process.

4) FIGS. 21A and 21B illustrate the fifth embodiment of the present invention. As shown in FIGS. 21A and 21B, a thread retaining mechanism 70D is provided with a second thread retaining member 71D. The second thread retaining member 71D is arranged to the second thread guide member 26 leaving a predetermined small space t therebetween that allows the upper thread 9 guided to the second thread guide portion 26*d* of the second thread guide member 26 to pass through, and that is also capable of applying frictional resistance to the upper thread 9 when the upper thread 9 passes therethrough.

The second thread retaining member 71D, in the vicinity of the thread retaining portion 71*b* thereof, is bent one level higher so as to provide the small space t. The second thread retaining member 71D is fixed by a screw 78 in the portion close to the thread retaining portion 71*b*. The upper thread 9 is guided by the small space t (for example, 0.1 to 0.2 mm). In such construction, at the time of hooking the upper thread 9, the upper thread 9 can be easily inserted between the first thread retaining member 71D and the second thread guide portion 26*d* having the predetermined small space t, as well as retaining the upper thread 9 with the frictional resistance. Hence, upon needle threading, since the upper thread 9 is not clamped and the resistance operated on the upper thread 9 is small, the force operated upon the reverting movement and the ascending movement of the needle threading hook 32 can be reduced.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A needle threading device of a sewing machine comprising:

a needle threading shaft provided rotatably and vertically movably to a needle bar base and provided in close proximity to a needle bar;

a needle threading hook which is fixed to a lower end of the needle threading shaft and which is capable of passing through an needle eye of a sewing needle;

a rotating mechanism that rotates the needle threading shaft such that the needle threading hook passes through the needle eye of the sewing needle when the needle threading shaft is lowered to a substantial lowermost position thereof;

a first thread guide member which is fixed to the lower end of the needle threading shaft and which is arranged to an opposite side of the needle threading hook with respect to the needle threading shaft;

a second thread guide member which is pivotally mounted on the lower end of the needle threading shaft and which is linked to the first thread guide member via a link mechanism, whereupon in rotation of the needle threading shaft, the second thread guide member retains an upper thread in a predetermined position near the needle eye of the sewing needle cooperatively with the first thread guide member; and a thread retaining unit provided on the second thread guide member that retains the upper thread at the time of hooking the upper thread by cooperating with the second thread guide member.

2. The needle threading device according to claim 1, wherein the second thread guide member is provided with a thread guide portion that guides the upper thread.

3. The needle threading device according to claim 2, wherein the second thread guide member is provided with a thread introducing portion that introduces the upper thread to the thread guide portion; and the thread retaining unit is provided with a thread retaining member movable between an opened position where the thread retaining unit opens the thread introducing portion so as to enable the hooking of the upper thread and a closed position where the thread retaining unit closes the thread introducing portion so as to retain the upper thread guided to the thread guide portion in cooperation with the second thread guide member; and an elastic member that biases the thread retaining member toward the closed position.

4. The needle threading device according to claim 3, wherein the thread retaining member is arranged to be positioned in the opened position when the second thread guide member is in a stand-by position for hooking the upper thread, and in the closed position when the second thread guide member starts rotating toward the needle eye from the stand-by position.

5. The needle threading device according to claim 4, further comprising a thread retaining portion provided in the thread retaining member for retaining the upper thread in cooperation with the second guide member, wherein the elastic member is arranged so that the bias of the elastic member operates in a direction to move the thread retaining member to the closed position, as well as in a direction to press the thread retaining portion against the second thread guide member.

6. The needle threading device according to claim 2, wherein the thread retaining unit is provided with a thread retaining member that retains the upper thread guided to the thread guide portion; and a biasing member that elastically biases the thread retaining member in a direction to press the thread retaining member against the second thread guide member.

7. The needle threading device according to claim 2, wherein the thread retaining unit is provided with a thread retaining member which retains the upper thread guided to the thread guide portion, and which is constructed of an elastic material that applies bias toward a direction to press against the second thread guide member.

8. The needle threading device according to claim 2, wherein the thread retaining unit has a thread retaining member which is arranged to the second thread guide member leaving a predetermined small space therebetween that allows the upper thread guided to the thread guide portion to pass through and that is capable of applying frictional resistance to the upper thread when passing therethrough.

9. The needle threading device according to claim 1, further comprising a thread cutter that cuts the upper thread which is retained by the thread retaining unit in a location in a lower stream in a thread supplying direction than the thread retaining unit is provided in a predetermined portion of a main body cover such that a part of the upper thread from the thread retaining unit to the cut thread end has such a length that the thread end can be pulled out from the needle eye by a reverting movement of the needle threading hook.

10. A sewing machine provided with a needle threading device comprising:

a needle threading shaft provided rotatably and vertically movably to a needle bar base and provided in close proximity to a needle bar;

a needle retaining hook which is fixed to a lower end of the needle threading shaft and which is capable of passing through an needle eye of a sewing needle;

a rotating mechanism that rotates the needle threading shaft so that the needle threading hook passes through the needle eye of the sewing needle when the needle threading shaft is lowered to a substantial lower most position thereof;

a first thread guide member which is fixed to the lower end of the needle threading shaft and which is arranged to an opposite side of the needle threading hook with respect to the needle threading shaft;

a second thread guide member which is pivotally mounted on the lower end of the needle threading shaft and which is linked to the first thread guide member via a link mechanism, whereupon rotation of the needle threading shaft, the second thread guide member retains an upper thread in a predetermined position near the needle eye in cooperation with the first thread guide member; and a thread retaining unit provided in the second thread guide member that retains the upper thread at the time of hooking the upper thread by cooperating with the second thread guide member.

11. The sewing machine according to claim 10, wherein the second thread guide member is provided with a thread guide portion that guides the upper thread.

12. The sewing machine according to claim 11, wherein the second thread guide member is provided with a thread introducing portion that introduces the upper thread to the thread guide portion; and the thread retaining unit is provided with a thread retaining member movable between an opened position that opens the thread introducing portion so as to enable the hooking of the upper thread and a closed portion that closes the thread introducing portion so as to retain the upper thread guided to the thread guide portion cooperatively with the second thread guide member; and an elastic member that biases the thread retaining member toward the closed position.

13. The sewing machine according to claim 12, wherein the thread retaining member is arranged to be positioned in the opened position when the second thread guide member is in a stand-by position for hooking the upper thread, and in the closed position when the second thread guide member starts rotating toward the needle eye from the stand-by position.

14. The sewing machine according to claim 13, wherein a thread retaining portion that retains the upper thread cooperatively with the second thread guide member is provided in the thread retaining member, and the elastic member is arranged so that the bias of the elastic member operates in a direction to move the thread retaining member to the closed position, as well as in a direction to press the thread retaining portion against the second thread guide member.

15. The sewing machine according to claim 11, wherein the thread retaining unit is provided with the thread retaining member that retains the upper thread guided to the thread guide portion; and a biasing member that elastically biases the thread retaining member in a direction to press the thread retaining member against the second thread guide member.

16. The sewing machine according to claim 11, wherein the thread retaining unit is provided with a thread retaining member which retains the upper thread guided to the thread guide portion, and which is constructed of an elastic material that applies bias toward a direction to press against the second thread guide member.

17. The sewing machine according to claim 11, wherein the thread retaining unit has a thread retaining member which is arranged to the second thread guide member leaving a predetermined small space therebetween that allows the upper thread guided to the thread guide portion to pass through and that is capable of applying frictional resistance to the upper thread when passing therethrough.

18. The sewing machine according to claim 10, further comprising a thread cutter that cuts the upper thread which is retained by the thread retaining unit in a location in a lower stream in a thread supplying direction than the thread retaining unit is provided in a predetermined portion of a main body cover such that the length of the upper thread from the thread retaining unit to the cut thread end is of such length that the thread end can be pulled out from the needle eye by a reverting movement of the needle threading hook.

19. The sewing machine according to claim 10, further comprising:

a needle threading operation unit that activates the needle threading device, a thread tension mechanism that adjusts the thread tension of the upper thread, a thread tension controlling unit that controls the thread tension mechanism are provided, wherein the needle threading the needle is carried out eye by the needle threading operation unit, the thread tension controlling unit controls a value set for upper thread tension in the thread tension mechanism to a predetermined value that prevents drawing of the needle thread.

20. The sewing machine according to claim 19, wherein the needle threading operation unit is provided with a needle threading operation member that operates the needle threading device and an activation detecting unit that detects the activation of the needle threading operation member.

21. The sewing machine according to claim 20, wherein the thread tension controlling unit controls the thread tension mechanism based on a detection signal sent from the activation detecting unit.

22. A sewing machine provided with a needle threading device comprising a needle threading shaft provided rotatably and vertically movably near a needle bar of a sewing machine, a needle threading hook which is fixed to a lower end of the needle threading shaft and which is capable of passing through a needle eye of a sewing needle, a rotating mechanism that rotates the needle threading hook, the sewing machine comprising:

a needle threading operation unit that activates the needle threading device;

a thread tension mechanism that adjusts the thread tension of the upper thread; and a thread tension controlling unit that controls the thread tension mechanism are provided, wherein when needle threading the needle is carried out by the needle threading operation unit, the thread tension controlling unit controls a value set for upper thread tension in the thread tension mechanism to a predetermined value that prevents drawing of the needle thread.

23. The sewing machine according to claim 22, wherein the needle threading operation unit is provided with a needle threading operation member that operates the needle threading device and a activation detecting unit that detects the activation of the needle threading operation member.

24. The sewing machine according to claim 23, wherein the thread tension controlling unit controls the thread tension mechanism based on a detection signal sent from the activation detecting unit.

* * * * *